US007873295B2

(12) United States Patent
Yamaguchi

(10) Patent No.: US 7,873,295 B2
(45) Date of Patent: Jan. 18, 2011

(54) IMAGE FORMING SYSTEM, IMAGE FORMING APPARATUS, AND METHOD OF RECOVERING FROM ENERGY SAVING MODE

(75) Inventor: Kohhei Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 185 days.

(21) Appl. No.: 12/175,981

(22) Filed: Jul. 18, 2008

(65) Prior Publication Data

US 2009/0022508 A1 Jan. 22, 2009

(30) Foreign Application Priority Data

Jul. 18, 2007 (JP) ..... 2007-187640
Jul. 11, 2008 (JP) ..... 2008-180876

(51) Int. Cl.
*G03G 15/00* (2006.01)

(52) U.S. Cl. ..... 399/88; 399/8

(58) Field of Classification Search ..... 399/8, 399/75, 88, 90
See application file for complete search history.

(56) References Cited

U.S. PATENT DOCUMENTS 5,915,148 A * 6/1999 Hamaguchi et al. ..... 399/77
2007/0260358 A1* 11/2007 Katoh ..... 700/286

FOREIGN PATENT DOCUMENTS

| | | |
|---|---|---|
| JP | 9-321920 | 12/1997 |
| JP | 2003-162398 | 6/2003 |
| JP | 2005-195906 | 7/2005 |
| JP | 2008-126642 | 6/2008 |

* cited by examiner

*Primary Examiner*—Hoang Ngo
(74) *Attorney, Agent, or Firm*—Oblon, Spivak, McClelland, Maier & Neustadt, L.L.P.

(57) ABSTRACT

An energy-saving control unit detects a supply of power to an image forming apparatus and performs an energy saving control of an external controller. A switching unit switches a start and a stop of supply of power to an onboard circuit of the external controller. Upon detecting the supply of power to the image forming apparatus, the energy-saving control unit sends a power control signal for instructing a start of the supply of power to the onboard circuit to the switching unit. Upon receiving the power control signal, the switching unit switches to the start of the supply of power to the onboard circuit.

15 Claims, 16 Drawing Sheets

IMAGE FORMING SYSTEM, IMAGE FORMING APPARATUS, AND METHOD OF RECOVERING FROM ENERGY SAVING MODE

CROSS-REFERENCE TO RELATED APPLICATIONS

The present application claims priority to and incorporates by reference the entire contents of Japanese priority document 2007-187640 filed in Japan on Jul. 18, 2007 and Japanese priority document 2008-180876 filed in Japan on Jul. 11, 2008.

BACKGROUND OF THE INVENTION

1. Field of the Invention

The present invention relates to an image forming system, an image forming apparatus, and a method of recovering the image forming system from an energy saving mode.

2. Description of the Related Art

In image forming systems including external controllers that receive a printing request from client terminals and image forming apparatuses that are connected to the external controllers via a network and perform printing and reading of images based on the printing request from the external controllers, it is required to reduce power consumption and realize quick start up. Specifically, it is preferable that the external controllers enter in an energy saving mode in conjunction with power OFF of the image forming apparatuses and recover from the energy saving mode in conjunction with power ON of the image forming apparatuses.

However, if the image forming apparatuses and the external controllers are connected to each other via Ethernet (registered trademark) and when power supply to Ethernet circuits is suspended because the external controller enters in the energy saving mode, Ethernet functions are not effective. Therefore, it is difficult to recover the external controller from the energy saving mode in conjunction with power ON of the image forming apparatus.

A conventional technology for solving the above problems is disclosed in, for example, Japanese Patent Application Laid-open No. 2003-162398. In the conventional technology, a spread spectrum communication circuit of a power-supply-unit control circuit in a printer control circuit conducts data communication with an information processing apparatus via a distribution line. A power supply control unit controls a start and a stop of supply of power from a power supply circuit to a printer controller or a printer engine depending on attribute of communicated data. As a result, wiring of communication lines or control lines can be simple and extra connection lines are not needed. Furthermore, power consumption can be reduced to the same level as that attained in a standby mode in which image forming operation is suspended and supply of power is suspended.

However, in the conventional technologies, energy saving control is performed only when power is being supplied to both the information processing apparatus and the image forming apparatus. Therefore, if the image forming apparatus is powered OFF, the energy saving control cannot be performed.

SUMMARY OF THE INVENTION

It is an object of the present invention to at least partially solve the problems in the conventional technology.

According to an aspect of the present invention, there is provided an image forming system in which an image forming apparatus and an external controller are connected to each other via a network. The image forming apparatus includes a power supply unit that supplies power to the image forming apparatus. The external controller includes an energy-saving control unit that detects a supply of power to the image forming apparatus by the power supply unit and performs an energy saving control of the external controller based on a detection of the supply of power to the image forming apparatus, and a switching unit that switches a start and a stop of supply of power to an onboard circuit of the external controller. Upon detecting the supply of power to the image forming apparatus by the power supply unit, the energy-saving control unit sends a power control signal for instructing a start of the supply of power to the onboard circuit to the switching unit. Upon receiving the power control signal, the switching unit switches to the start of the supply of power to the onboard circuit.

Furthermore, according to another aspect of the present invention, there is provided an image forming apparatus configured to be connected to an external controller via a network, including a power supply unit that supplies power to the image forming apparatus; and a signal transmitting unit that transmits, when the power supply unit starts supplying the power to the image forming apparatus, a signal indicating that supply of power to the image forming apparatus is started to the external controller.

Moreover, according to still another aspect of the present invention, there is provide an energy saving recovery method for an image forming system including an image forming apparatus and an external controller connected to each other via a network. The energy saving recovery method includes energy-saving controlling including an energy-saving control unit of the external controller detecting a supply of power to the image forming apparatus by a power supply unit and performing an energy saving control of the external controller based on a detection of the supply of power to the image forming apparatus; and switching including a switching unit of the external controller switching a start and a stop of supply of power to an onboard circuit of the external controller. Upon detecting the supply of power to the image forming apparatus by the power supply unit, the energy-saving controlling further includes sending a power control signal for instructing a start of the supply of power to the onboard circuit to the switching unit. Upon receiving the power control signal, the switching further includes switching to the start of the supply of power to the onboard circuit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

An image forming system according to a first embodiment of the present invention includes an external controller that recovers from an energy saving mode in conjunction with power ON of an image forming apparatus. Specifically, upon detection of a start of power supply to the image forming apparatus, the external controller restarts power supply to circuits and recovers from an energy saving mode in which power supply to the circuits is suspended.

Figure 1:
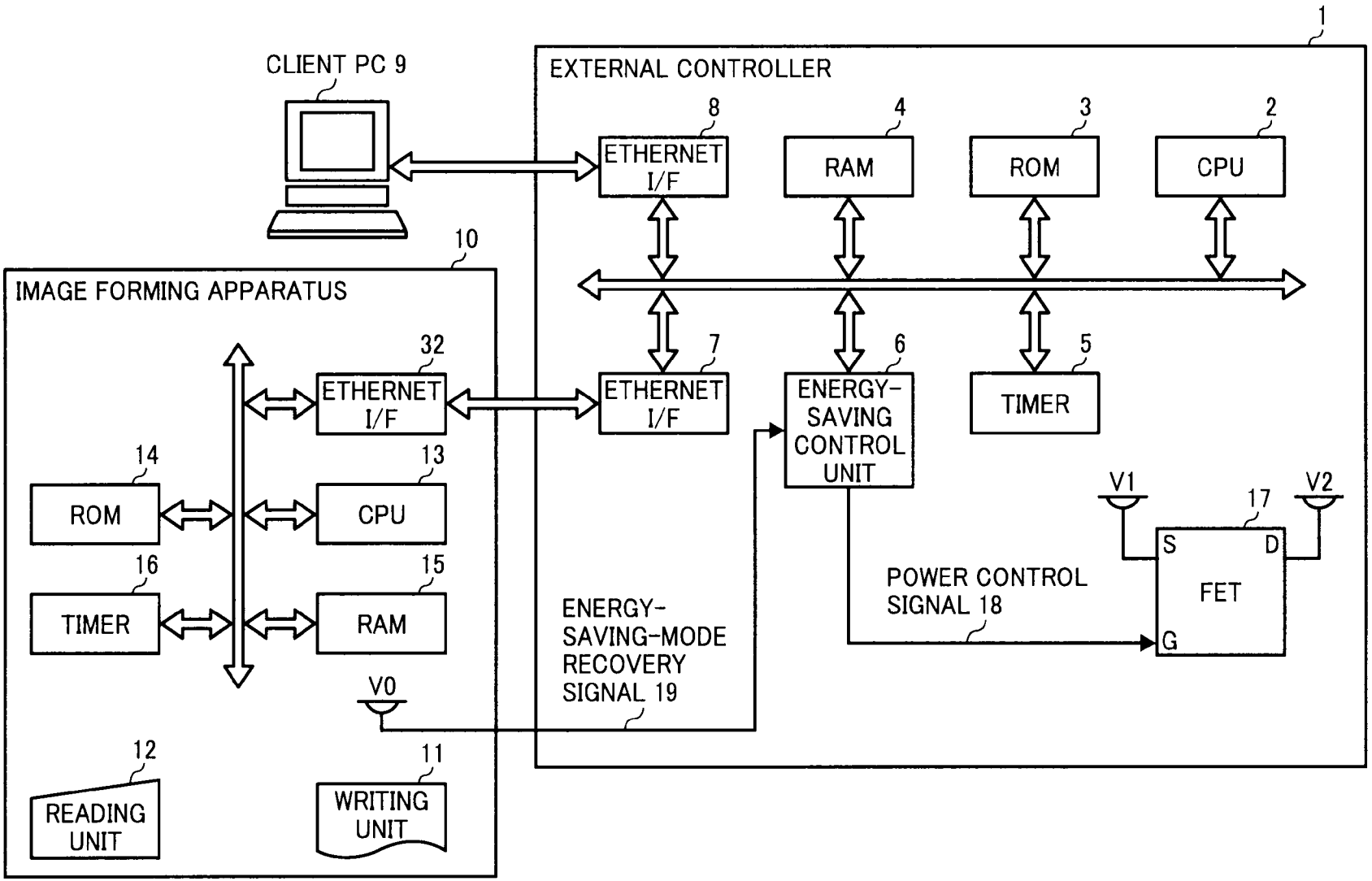
FIG. 1 is a block diagram of an image forming system according to a first embodiment of the present invention.

FIG. 1 is a block diagram of the image forming system according to the first embodiment. The image forming system includes an external controller 1 and an image forming apparatus 10 connected to each other via Ethernet (registered trademark). The external controller 1 and the image forming apparatus 10 can be connected to each other via other high-speed interfaces (I/F) such as PCI Express or USB.

The external controller 1 includes a central processing unit (CPU) 2, a read only memory (ROM) 3, a random access memory (RAM) 4, a timer 5, an energy-saving control unit 6, Ethernet I/Fs 7 and 8, and a field-effect transistor (FET) 17, connected to one another via a system bus. The energy-saving control unit 6 controls ON/OFF of the FET 17 based on events associated with transition and recovery to and from an energy saving mode.

The external controller 1 includes a function for converting image data transmitted from an external device, such as a client personal computer (PC) 9, into data that can be used for printing and displaying an image of the image data by the image forming apparatus 10. The external controller 1 also includes a function for converting image data to and from image signals.

The CPU 2 controls the ROM 3, the RAM 4, the timer 5, the energy-saving control unit 6, and the Ethernet I/Fs 7 and 8.

The timer 5 measures time when the CPU 2 controls the above units on a circuit.

Upon receipt of an energy-saving-mode recovery signal 19 at high level from the image forming apparatus 10, the energy-saving control unit 6 turns ON the FET 17 by a power control signal 18 that controls a gate of the FET 17. Therefore, power supply to the units in the energy saving mode in the external controller 1 is started. On the other hand, upon receipt of the energy-saving-mode recovery signal 19 at low level, the energy-saving control unit 6 turns OFF the FET 17 by the power control signal 18. Therefore, power supply to the circuits on the external controller 1 is suspended.

The energy-saving-mode recovery signal 19 indicates whether power supply is started (restarted) from a power source V0 to circuits that are in the energy saving mode in the image forming apparatus 10. Specifically, when the energy-saving-mode recovery signal 19 is at high level, it indicates that power supply is started (restarted) from the power source V0 to the circuits in the energy saving mode in the image forming apparatus 10. According to the first embodiment, the energy-saving-mode recovery signal 19 is generated when power supply to the image forming apparatus 10 is restarted and then sent to the external controller 1.

A power source V1 is ON even in the energy saving mode. On the other hand, a power source V2 is OFF in the energy saving mode.

The image forming apparatus 10 includes a writing unit 11, a reading unit 12, a CPU 13, a ROM 14, a RAM 15, a timer 16, and an Ethernet I/F 32, connected to one another via a system bus. The CPU 13 controls the ROM 14, the RAM 15, the timer 16, and the Ethernet I/F 32.

The external controller 1 is connected to the client PC 9 via the Ethernet I/F 8, and to the image forming apparatus 10 via the Ethernet I/F 7.

The FET 17 switches a start and a stop of power supply to circuits on the external controller 1.

The energy-saving control unit 6 detects a start of power supply to the image forming apparatus 10 upon receipt of the energy-saving-mode recovery signal 19 at high level indicating that power supply is started (restarted) from the power source V0 to the circuits in the energy saving mode in the image forming apparatus 10. Then, the energy-saving control unit 6 performs energy saving control on the external controller 1.

The level of the energy-saving-mode recovery signal 19 is changed in conjunction with the power source V0 of the image forming apparatus 10. Specifically, the energy-saving-mode recovery signal 19 is set to high level when the power source V0 is turned ON and to low level when the power source V0 is turned OFF. The energy-saving-mode recovery signal 19 is sent from the image forming apparatus 10 to the energy-saving control unit 6 of the external controller 1.

That is, upon receipt of the energy-saving-mode recovery signal 19 at high level from the image forming apparatus 10, the energy-saving control unit 6 sends to the FET 17 the power control signal 18 of ON that leads to a start of power supply to the circuits on the external controller 1 so that the FET 17 is powered ON. Upon receipt of the power control signal 18 of ON, the FET 17 enters an ON state and starts power supply to the circuits such as the Ethernet I/F 7 of the external controller 1.

On the other hand, when the power source V0 is turned OFF, the energy-saving-mode recovery signal 19 at low level is sent to the energy-saving control unit 6. Upon receipt of the energy-saving-mode recovery signal 19 at low level, the energy-saving control unit 6 sends to the FET 17 the power control signal 18 of OFF that leads to a suspension of power supply to the circuits on the external controller 1 so that the FET 17 is powered OFF. As a result, the FET 17 enters an OFF state and stops power supply to the circuits such as the Ethernet I/F 7 in the external controller 1.

Figure 2:
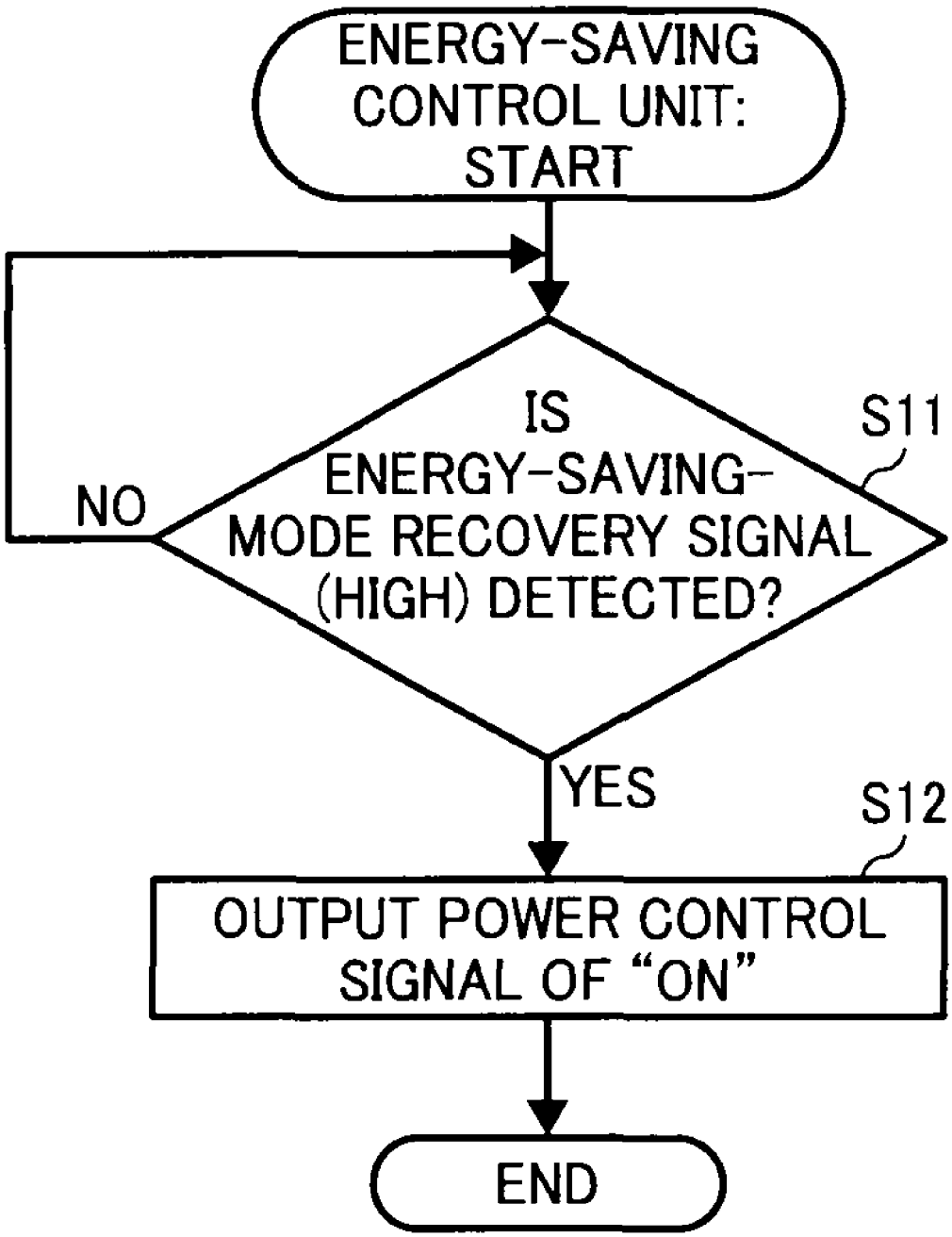
FIG. 2 is a flowchart of an energy-saving-mode recovery process according to the first embodiment.

An energy-saving-mode recovery process performed by the image forming system according to the first embodiment is described with reference to a flowchart shown in FIG. 2.

When the power source of the image forming apparatus 10 is OFF, the energy-saving control unit 6 turns OFF the FET 17 by the power control signal 18. At this state, power supply to the Ethernet I/F 7 is suspended. The energy-saving-mode recovery process is a recovery process from the energy saving mode in which power supply to the Ethernet I/F 7 is suspended.

When power supply to the Ethernet I/F 7 is suspended in the external controller 1, the energy-saving control unit 6 awaits the energy-saving-mode recovery signal 19 at high level indicating that power supply is started to the image forming apparatus 10 (Step S11).

When the power source V0 of the image forming apparatus 10 is turned ON while power supply to the Ethernet I/F 7 in the external controller 1 is suspended, the power source V0 enters an ON state. Then, the image forming apparatus 10 changes the level of the energy-saving-mode recovery signal 19 from low level to high level and sends the energy-saving-mode recovery signal 19 to the external controller 1.

Upon receipt of the energy-saving-mode recovery signal 19 at high level (Yes at Step S11), the energy-saving control unit 6 determines that power is being supplied to the image forming apparatus 10. Then, the energy-saving control unit 6 sets the power control signal 18 to ON and outputs the power control signal 18 of ON to the FET 17 (Step S12). Upon receipt of the power control signal 18 of ON, the FET 17 enters an ON state and starts power supply to the circuits such as the Ethernet I/F 7 in the energy saving mode in the external controller 1. As a result, the external controller 1 recovers from the energy saving mode.

When the energy-saving control unit 6 does not receive the energy-saving-mode recovery signal 19 at high level (No at Step S11), process control does not proceed to next step.

As described above, according to the first embodiment, power supply to the circuits in the energy saving mode in the external controller 1 is restarted upon detecting that power is being supplied to the image forming apparatus 10. Therefore, the external controller 1 can recover from the energy saving mode in conjunction with power ON of the image forming apparatus 10.

An image forming system according to a second embodiment of the present invention is described below. When the image forming apparatus 10 is powered ON, link negotiation is performed on Ethernet so that levels of signals on Ethernet changes. An external controller detects the change of levels of signals on Ethernet and then restarts power supply to the circuits in the energy saving mode in the external controller. Thus, the external controller can recover from the energy saving mode in conjunction with power ON of the image forming apparatus 10.

Figure 3:
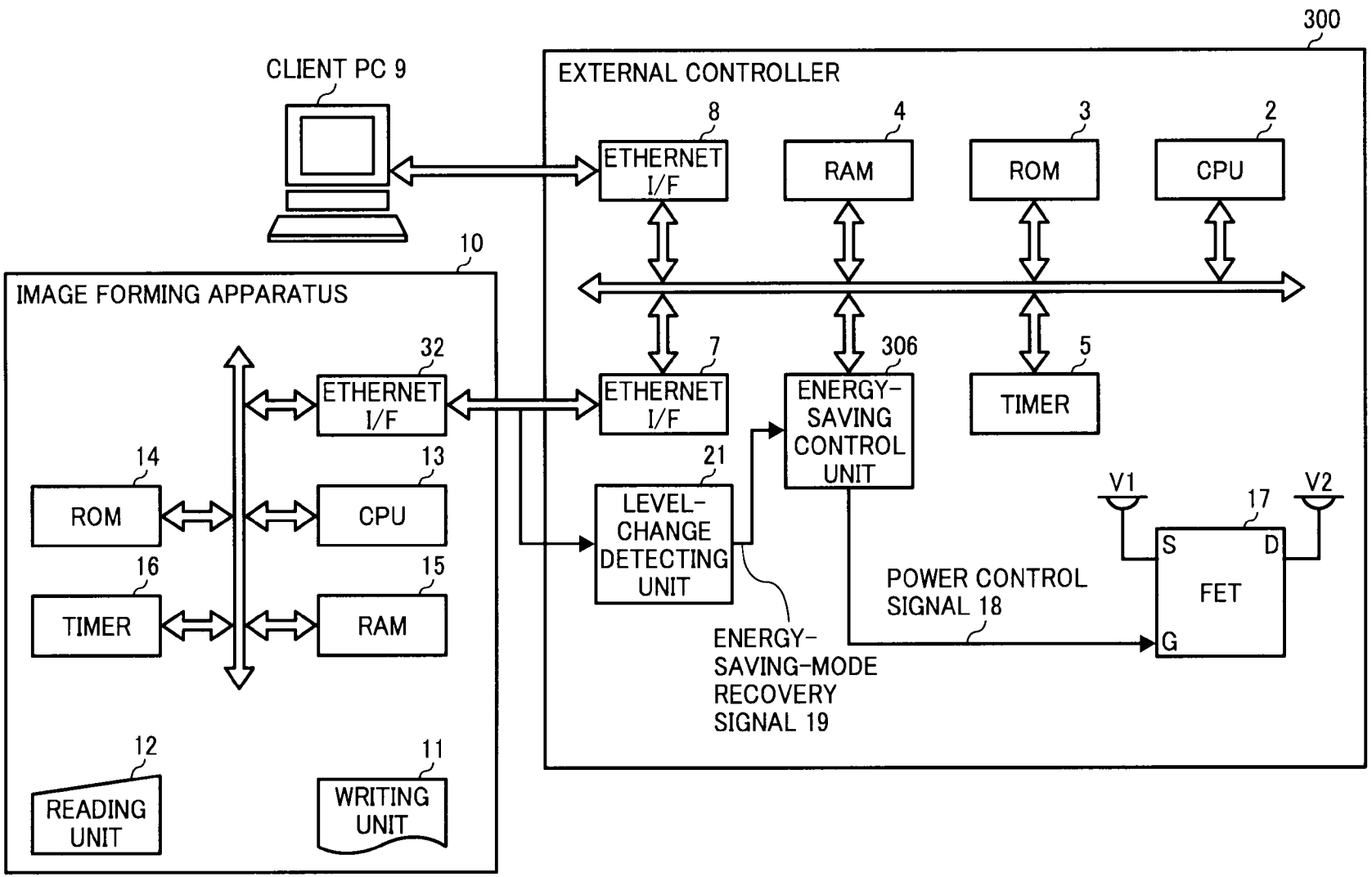
FIG. 3 is block diagram of an image forming system according to a second embodiment of the present invention.

FIG. 3 is a block diagram of the image forming system according to the second embodiment. The image forming system according to the second embodiment includes an external controller 300 and the image forming apparatus 10 connected to each other via Ethernet (registered trademark). The image forming apparatus 10 is the same as that described in the first embodiment.

The external controller 300 includes the CPU 2, a level-change detecting unit 21, the ROM 3, the RAM 4, the timer 5, an energy-saving control unit 306, the Ethernet I/Fs 7 and 8, and the FET 17, connected to one another via a system bus. The energy-saving control unit 306 controls ON/OFF of the FET 17 based on events associated with transition and recovery to and from an energy saving mode. The CPU 2, the ROM 3, the RAM 4, the timer 5, the Ethernet I/Fs 7 and 8, and the FET 17 are the same as those described in the first embodiment, so that the same explanations are not repeated.

The level-change detecting unit 21 detects a change of the level of a signal transmitted between the Ethernet I/F 32 and the Ethernet I/F 7. Specifically, the level-change detecting unit 21 monitors a received signal (RX+ and RX−) of the Ethernet. When the image forming apparatus 10 is powered ON, the level-change detecting unit 21 detects a change of the level of a signal caused by link negotiation between the Ethernet I/F 32 and the Ethernet I/F 7. Upon detecting the change of the level of the signal caused by the link negotiation, the level-change detecting unit 21 sends the energy-saving-mode recovery signal 19 at high level to the energy-saving control unit 306.

Upon receipt of the energy-saving-mode recovery signal 19 at high level, the energy-saving control unit 306 determines that the level of the signal transmitted between the Ethernet I/F 32 and the Ethernet I/F 7 is changed. That is, the energy-saving control unit 306 determines that power is being supplied to the image forming apparatus 10. Then, the energy-saving control unit 306 sends to the FET 17 the power control signal 18 of ON that leads to a start of power supply to the circuits on the external controller 300 so that the FET 17 is powered ON. Similar to the first embodiment, upon receipt of the power control signal 18 of ON, the FET 17 enters an ON state and starts power supply to the circuits such as the Ethernet I/F 7 on the external controller 300.

Figure 4:
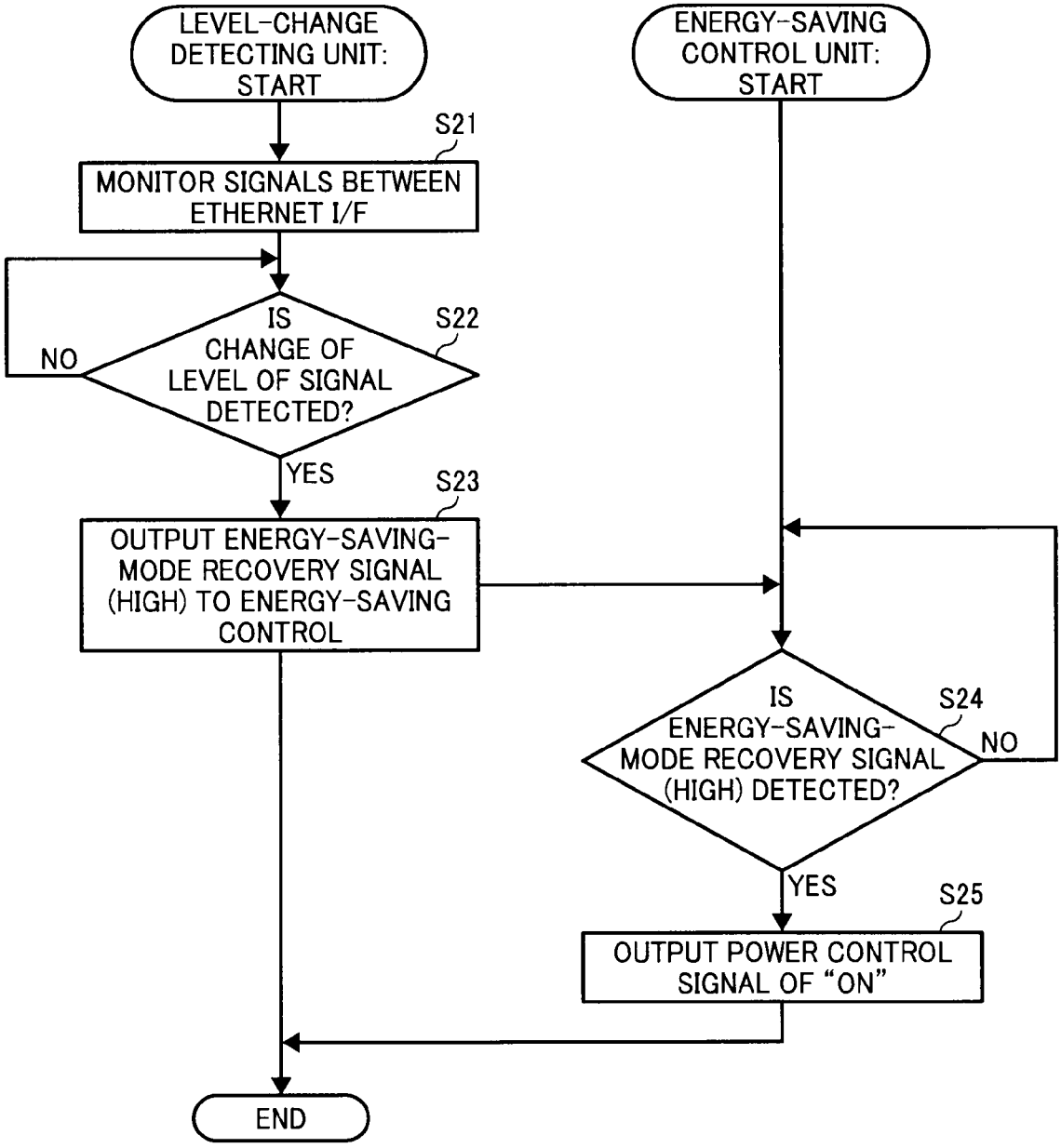
FIG. 4 is a flowchart of an energy-saving-mode recovery process according to the second embodiment.

An energy-saving-mode recovery process performed by the image forming system according to the second embodiment is described with reference to a flowchart shown in FIG. 4.

When a power source of the image forming apparatus 10 is OFF, the energy-saving control unit 306 turns OFF the FET 17 by the power control signal 18. At this state, power supply to the Ethernet I/F 7 is suspended. The energy-saving-mode recovery process is a recovery process from the energy saving mode in which power supply to the Ethernet I/F 7 is suspended.

When the image forming apparatus 10 is powered ON, link negotiation is started between the Ethernet I/F 32 and the Ethernet I/F 7. The level-change detecting unit 21 monitors signals transmitted between the Ethernet I/F 32 and the Ethernet I/F 7 (Step S21). When the level of the signal transmitted between the Ethernet I/F 32 and the Ethernet I/F 7 changes due to the link negotiation, the level-change detecting unit 21 detects the change of the level of the signal (Yes at Step S22). Then, the level-change detecting unit 21 changes the level of the energy-saving-mode recovery signal 19 to high level and outputs the energy-saving-mode recovery signal 19 at high level to the energy-saving control unit 306 (Step S23). When the level-change detecting unit 21 does not detect the change of the level of the signal (No at Step S22), process control does not proceed to next step.

When power supply to the Ethernet I/F 7 is suspended in the external controller 300, the energy-saving control unit 306 awaits the energy-saving-mode recovery signal 19 at high level indicating that power supply is started to the image forming apparatus 10 (Step S24). Upon receipt of the energy-saving-mode recovery signal 19 at high level (Yes at Step S24), the energy-saving control unit 306 determines that power is being supplied to the image forming apparatus 10.

Then, the energy-saving control unit 306 sets the power control signal 18 to ON and outputs the power control signal 18 of ON to the FET 17 (Step S25). Upon receipt of the power control signal 18 of ON, the FET 17 enters an ON state and restarts power supply to the circuits such as the Ethernet I/F 7 in the energy saving mode in the external controller 300. As a result, the external controller 300 recovers from the energy saving mode.

As described above, according to the second embodiment, when the image forming apparatus 10 is powered ON, link negotiation is performed on the Ethernets, so that levels of signals on the Ethernets changes. Upon detecting the change of levels of signals on the Ethernets, the external controller 300 determines that power supply to the image forming apparatus 10 is started (restarted) and then restarts power supply to the circuits in the energy saving mode in the external controller 300. Thus, the external controller 300 can recover from the energy saving mode in conjunction with power ON of the image forming apparatus 10.

According to the first and the second embodiments, the image forming apparatus 10 generates the energy-saving-mode recovery signal 19 at high level indicating that power supply is started to the image forming apparatus 10, and sends the energy-saving-mode recovery signal 19 to the external controllers 1 and 300. According to a third embodiment of the present invention, an external controller generates an energy-saving-mode recovery signal. When the energy-saving-mode recovery signal is generated and detected, power supply to the image forming apparatus 10 is started. Thus, the external controller according to the third embodiment can recover from the energy saving mode in conjunction with power ON of the image forming apparatus.

Figure 5:
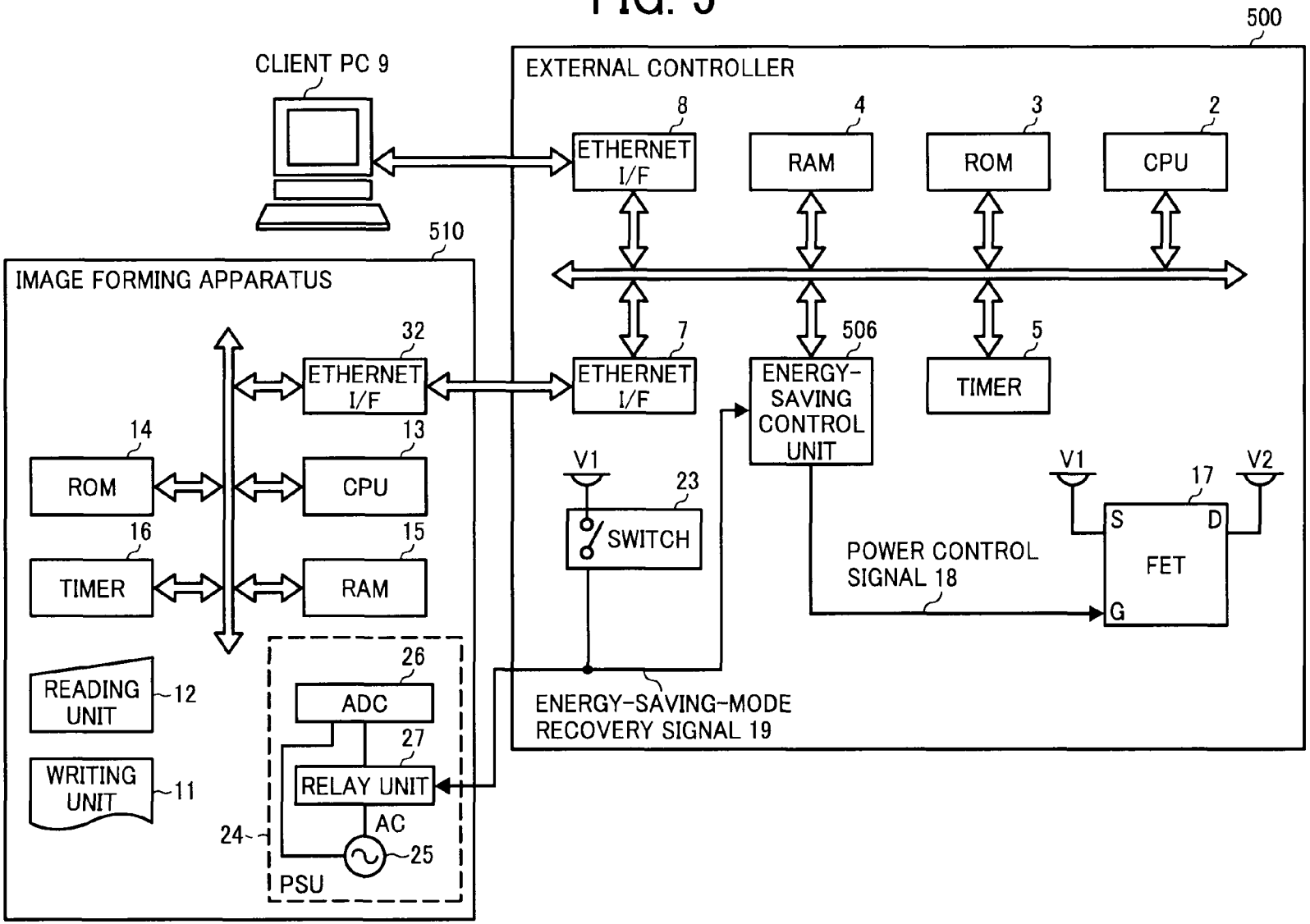
FIG. 5 is a block diagram of an image forming system according to a third embodiment of the present invention.

FIG. 5 is a block diagram of an image forming system according to the third embodiment. The image forming system according to the third embodiment includes an external controller 500 and an image forming apparatus 510 connected to each other via Ethernet (registered trademark).

The image forming apparatus 510 includes the writing unit 11, the reading unit 12, the CPU 13, the ROM 14, the RAM 15, the timer 16, and the Ethernet I/F 32, connected to one another via a system bus. The image forming apparatus 510 further includes a power supply unit (PSU) 24. The writing unit 11, the reading unit 12, the CPU 13, the RAM 15, the timer 16, and the Ethernet I/F 32 are the same as those described in the first embodiment.

The PSU 24 includes an AC/DC converter (ADC) 26, a relay unit 27, and an AC power source 25 ("AC 25" in FIG. 5). In the PSU 24, the ADC 26 converts alternating current into direct current in the AC 25. The PSU 24 starts and stops power supply to circuits on the image forming apparatus 510 due to switching by the relay unit 27.

The external controller 500 includes the CPU 2, the ROM 3, the RAM 4, the timer 5, an energy-saving control unit 506, and the Ethernet I/Fs 7 and 8, the FET 17, and a switch 23, connected to one another via a system bus. The energy-saving control unit 506 controls ON/OFF of the FET 17 based on events associated with transition and recovery to and from an energy saving mode. The CPU 2, the ROM 3, the RAM 4, the timer 5, the Ethernet I/Fs 7 and 8, and the FET 17 are the same as those described in the first embodiment, so that the same explanations are not repeated.

The switch 23 and a power source V1 generates the energy-saving-mode recovery signal 19. Specifically, when the switch 23 is turned ON, the energy-saving-mode recovery signal 19 at high level is generated by the power source V1. When the switch 23 is turned OFF, the energy-saving-mode recovery signal 19 at low level is generated.

Upon receipt of the energy-saving-mode recovery signal 19 at high level from the switch 23, the energy-saving control unit 506 turns ON the FET 17 by the power control signal 18 that controls the gate of the FET 17. Therefore, power supply to the units in the energy saving mode in the external controller 500 is started. On the other hand, upon receipt of the energy-saving-mode recovery signal 19 at low level, the energy-saving control unit 506 turns OFF the FET 17 by the power control signal 18. Therefore, power supply to the circuits on the external controller 500 is suspended. According to the third embodiment, the external controller 500 generates the energy-saving-mode recovery signal 19.

The switch 23 is connected to the relay unit 27 of the PSU 24 in the image forming apparatus 510. Therefore, the energy-saving-mode recovery signal 19 is transmitted from the switch 23 to the relay unit 27. When the energy-saving-mode recovery signal 19 is at high level, the relay unit 27 is powered ON so that power is supplied to the image forming apparatus 510. When the energy-saving-mode recovery signal 19 is at low level, the relay unit 27 is powered OFF so that supply of power to the image forming apparatus 510 is suspended.

Figure 6:
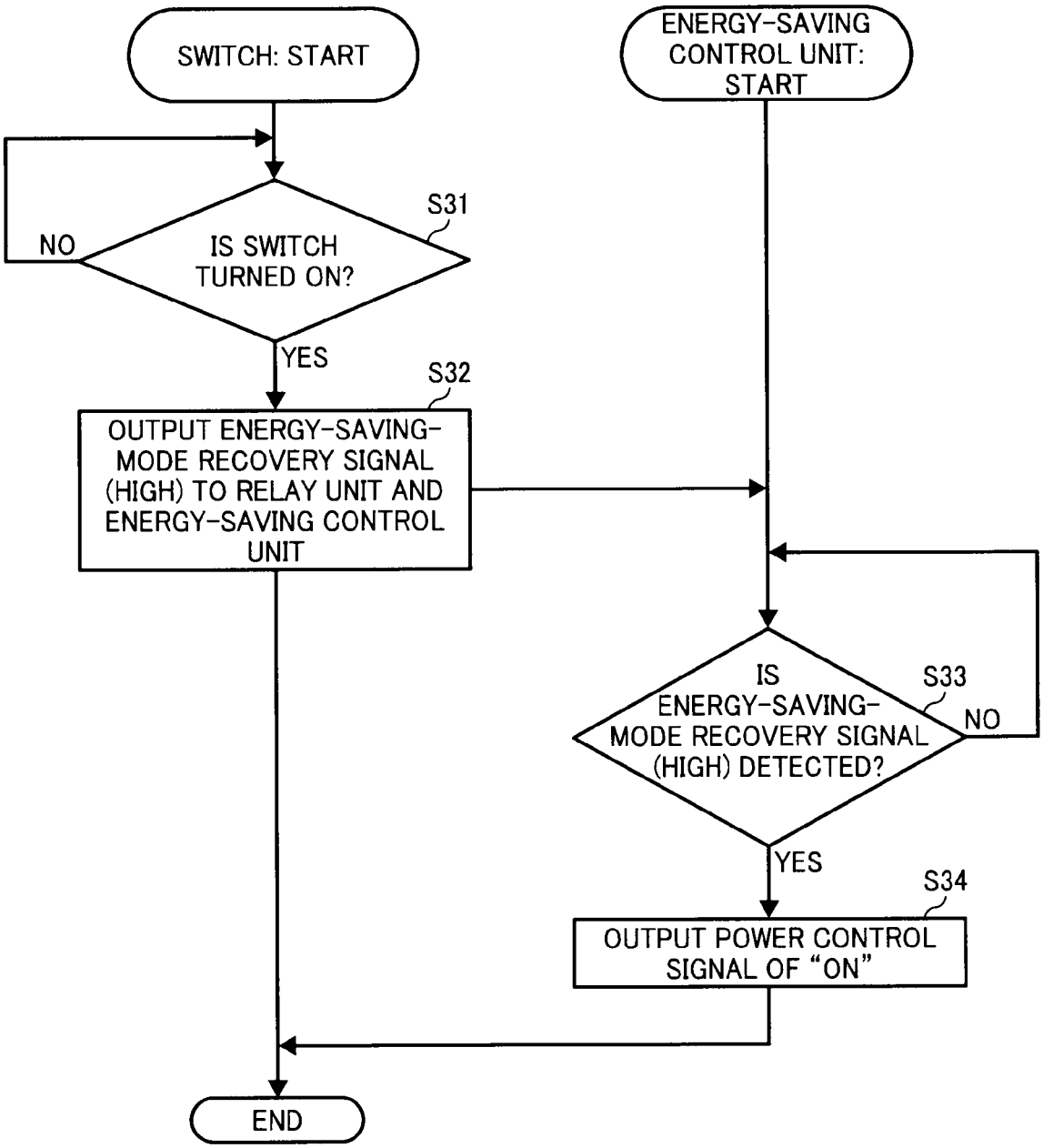
FIG. 6 is a flowchart of an energy-saving-mode recovery process according to the third embodiment.

An energy-saving-mode recovery process performed by the image forming system according to the third embodiment is described with reference to a flowchart shown in FIG. 6.

When the power source of the image forming apparatus 510 is OFF, the energy-saving control unit 506 turns OFF the FET 17 by the power control signal 18. At this state, power supply to the Ethernet I/F 7 is suspended. The energy-saving-mode recovery process is a process for recovering from the energy saving mode in which power supply to the Ethernet I/F 7 is suspended.

When the switch 23 is pressed, the switch 23 is turned ON (Yes at Step S31). The energy-saving-mode recovery signal 19 is set to high level and sent to the energy-saving control unit 506 and the relay unit 27 of the PSU 24 (Step S32).

In the image forming apparatus 510, the relay unit 27 is powered ON by the energy-saving-mode recovery signal 19 at high level, and the PSU 24 supplies power to the image forming apparatus 510.

Upon detection of the energy-saving-mode recovery signal 19 at high level (Yes at Step S33), the energy-saving control unit 506 determines that power is being supplied to the image forming apparatus 10.

Then, the energy-saving control unit 506 sets the power control signal 18 to ON and outputs the power control signal 18 of ON to the FET 17 (Step S34). Upon receipt of the power control signal 18 of ON, the FET 17 enters an ON state and restarts power supply to the circuits such as the Ethernet I/F 7 in the energy saving mode in the external controller 500. As a result, the external controller 500 recovers from the energy saving mode.

As described above, according to the third embodiment, the external controller 500 generates the energy-saving-mode recovery signal 19 that leads to a start of power supply to the image forming apparatus 510. Thus, the external controller 500 can recover from the energy saving mode in conjunction with power ON of the image forming apparatus 510.

A fourth embodiment of the present invention is described below. An optical sensor detects a light emitted from a light emitting diode (LED) in conjunction with power ON of an image forming apparatus. Then, power supply to circuits in the energy saving mode in an external controller is restarted based on detection of a light emission. Thus, the external controller can recover from the energy saving mode in conjunction with power ON of the image forming apparatus.

Figure 7:
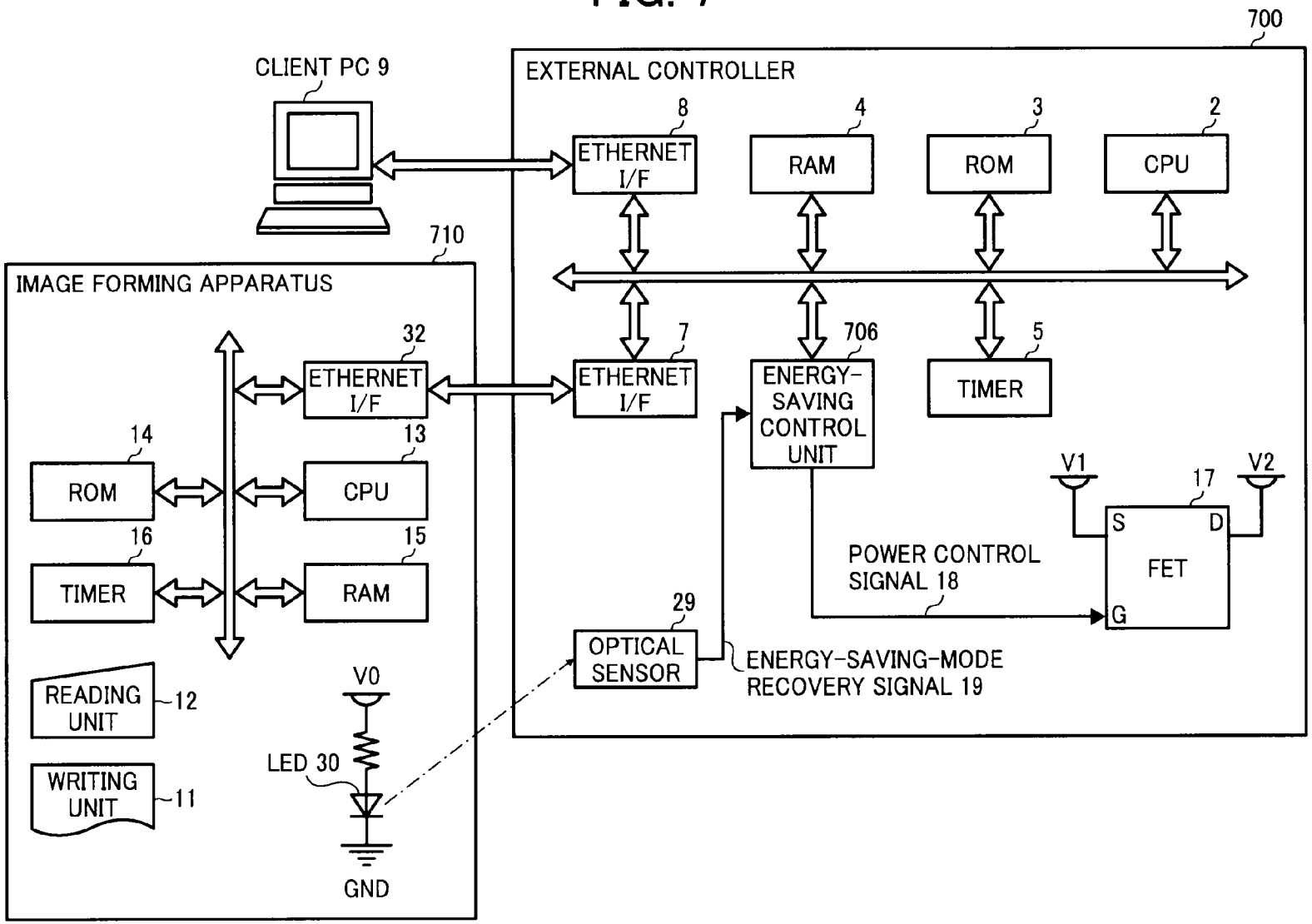
FIG. 7 is a block diagram of an image forming system according to a fourth embodiment of the present invention.

FIG. 7 is a block diagram of an image forming system according to the fourth embodiment. The image forming system according to the fourth embodiment includes an external controller 700 and an image forming apparatus 710 connected to each other via Ethernet (registered trademark) The image forming apparatus 710 has the same configuration as that described in the first embodiment.

The image forming apparatus 710 includes the writing unit 11, the reading unit 12, the CPU 13, the ROM 14, the RAM 15, the timer 16, and the Ethernet I/F 32, and an LED 30 connected to one another via a system bus. The writing unit 11, the reading unit 12, the CPU 13, the RAM 15, the timer 16, and the Ethernet I/F 32 are the same as those described in the first embodiment.

The LED 30 emits a light in conjunction with a start of power supply when the power source V0 is turned ON.

The external controller 700 includes the CPU 2, the ROM 3, the RAM 4, the timer 5, an optical sensor 29, an energy-saving control unit 706, the Ethernet I/Fs 7 and 8, and the FET 17, connected to one another via a system bus. The energy-saving control unit 706 controls ON/OFF of the FET 17 based on events associated with transition and recovery to and from an energy saving mode. The CPU 2, the ROM 3, the RAM 4, the timer 5, the Ethernet I/Fs 7 and 8, and the FET 17 are the same as those described in the first embodiment, so that the same explanations are not repeated.

Upon detection of light emission (optical signal) from the LED 30, the optical sensor 29 outputs the energy-saving-mode recovery signal 19 at high level to the energy-saving control unit 706. On the other hand, when light emission from the LED 30 is not detected, the optical sensor 29 outputs the energy-saving-mode recovery signal 19 at low level.

Upon receipt of the energy-saving-mode recovery signal 19 at high level from the optical sensor 29, the energy-saving control unit 706 turns ON the FET 17 by the power control signal 18 that controls the gate of the FET 17. Therefore, power supply to the units in the energy saving mode in the external controller 700 is started. On the other hand, upon receipt of the energy-saving-mode recovery signal 19 at low level, the energy-saving control unit 706 turns OFF the FET 17 by the power control signal 18. Therefore, power supply to the circuits on the external controller 700 is suspended.

Figure 8:
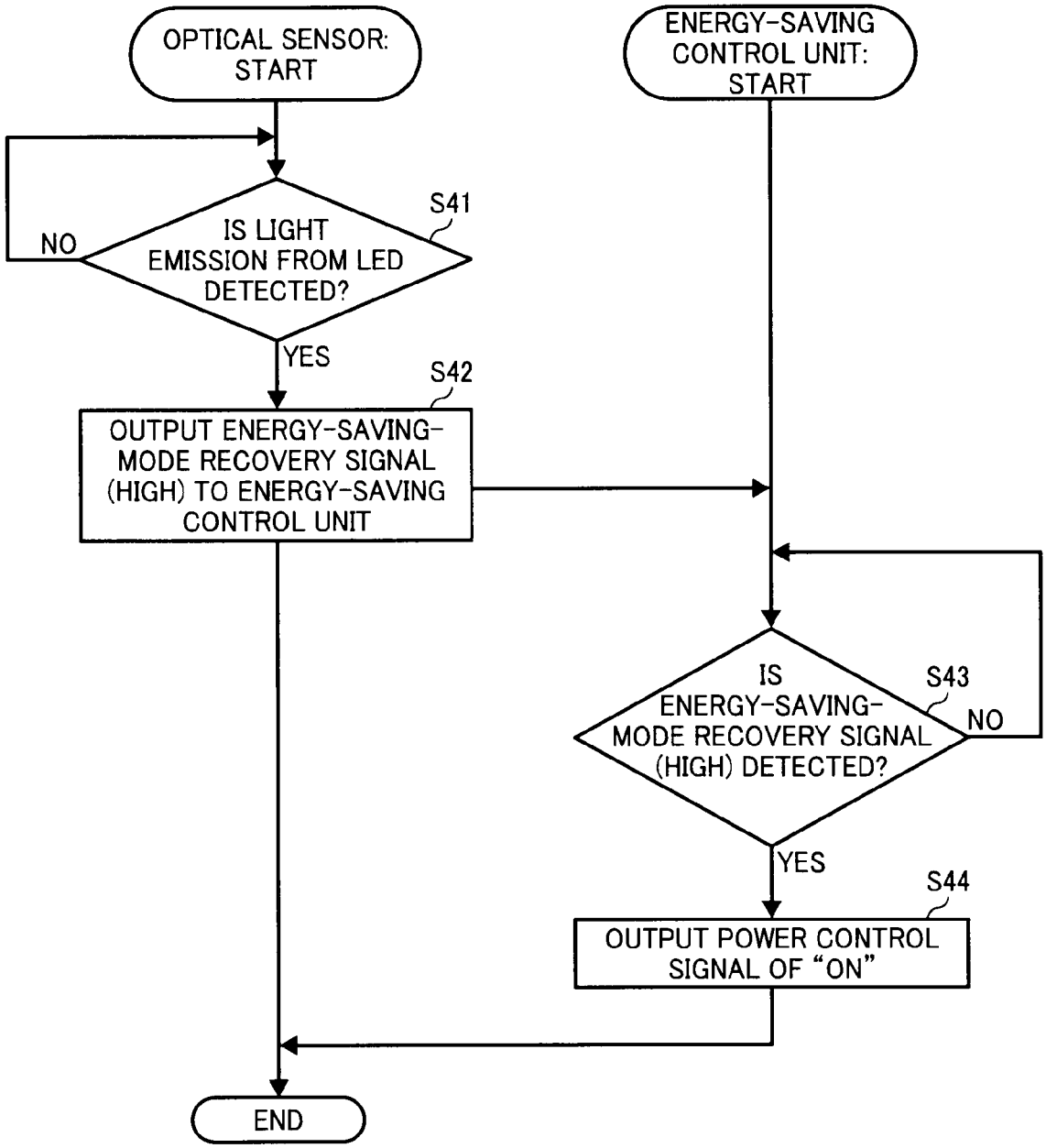
FIG. 8 is a flowchart of an energy-saving-mode recovery process according to the fourth embodiment.

An energy-saving-mode recovery process performed by the image forming system according to the fourth embodiment is described with reference to a flowchart shown in FIG. 8.

When the power source of the image forming apparatus 710 is OFF, the energy-saving control unit 706 turns OFF the FET 17 by the power control signal 18. At this state, power supply to the Ethernet I/F 7 is suspended. The energy-saving-mode recovery process is a process for recovering from the energy saving mode in which power supply to the Ethernet I/F 7 is suspended.

When the image forming apparatus 710 is powered ON while power supply to the Ethernet I/F 7 of the external controller 700 is suspended, the power source V0 is turned ON and the LED 30 emits a light.

Upon detection of a light emission (Yes at Step S41), the optical sensor 29 sets the level of the energy-saving-mode recovery signal 19 to high level and outputs the energy-saving-mode recovery signal 19 at high level to the energy-saving control unit 706 (Step S42).

Upon detection of the energy-saving-mode recovery signal 19 at high level (Yes at Step S43), the energy-saving control unit 706 determines that power is being supplied to the image forming apparatus 710.

Then, the energy-saving control unit 706 sets the power control signal 18 to ON and outputs the power control signal 18 of ON to the FET 17 (Step S44). Upon receipt of the power control signal 18 of ON, the FET 17 enters an ON state and restarts power supply to the circuits such as the Ethernet I/F 7 in the energy saving mode in the external controller 700. As a result, the external controller 700 recovers from the energy saving mode.

As described above, according to the fourth embodiment, the optical sensor 29 detects a light emission from the LED 30 in conjunction with power ON of the image forming apparatus 710, and power supply to the circuits in the energy saving mode in the external controller 700 is restarted upon detection of emitted light. Therefore, the external controller 700 can recover from the energy saving mode in conjunction with power ON of the image forming apparatus 710.

A fifth embodiment of the present invention is described below. When it is determined that power is being supplied to an image forming apparatus for a predetermined time based on detection of power supply, power supply to the circuits in the energy saving mode in an external controller is restarted. Therefore, it is possible to prevent erroneous detection of power supply caused by noise.

Figure 9:
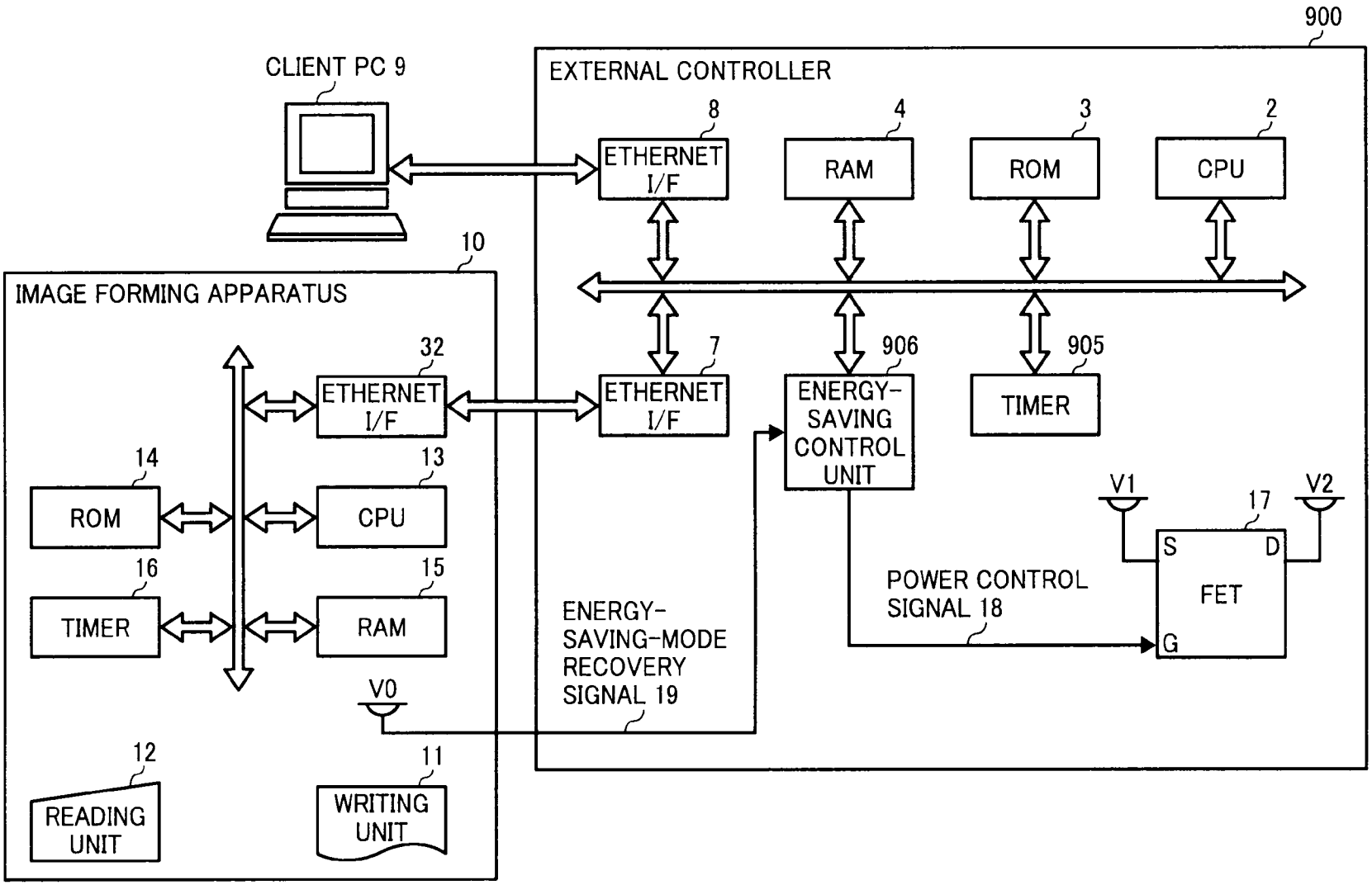
FIG. 9 is a block diagram of an image forming system according to a fifth embodiment of the present invention.

FIG. 9 is a block diagram of an image forming system according to the fifth embodiment. The image forming system according to the fifth embodiment includes an external controller 900 and the image forming apparatus 10 connected to each other via Ethernet (registered trademark). The image forming apparatus 10 is the same as that described in the first embodiment.

The external controller 900 includes the CPU 2, the ROM 3, the RAM 4, a timer 905, an energy-saving control unit 906, the Ethernet I/Fs 7 and 8, and the FET 17, connected to one another via a system bus. The energy-saving control unit 906 controls ON/OFF of the FET 17 based on events associated with transition and recovery to and from an energy saving mode. The CPU 2, the ROM 3, the RAM 4, the Ethernet I/Fs 7 and 8, and the FET 17 are the same as those described in the first embodiment, so that the same explanations are not repeated.

The timer 905 measures time to acquire a synchronous timing of the units, similar to the first embodiment. The timer 905 receives a command from the CPU 2 and measures time from when the energy-saving control unit 906 receives the energy-saving-mode recovery signal 19.

Upon receipt of the energy-saving-mode recovery signal 19 at high level from the image forming apparatus 10, the energy-saving control unit 906 determines whether the energy-saving-mode recovery signal 19 at high level is continuously detected for a predetermined time. The predetermined time is measured by the timer 905 from a time of receipt of the energy-saving-mode recovery signal 19. That is, it is determined whether the energy-saving control unit 906 continuously receives the energy-saving-mode recovery signal 19 at high level for a predetermined time. When the energy-saving-mode recovery signal 19 at high level is continuously detected for the predetermined time, the energy-saving control unit 906 sends to the FET 17 the power control signal 18 of ON that leads to a start of power supply to the circuits on the external controller 900, so that the FET 17 is powered ON. When the energy-saving-mode recovery signal 19 at high level is not continuously detected for the predetermined time, the energy-saving control unit 906 does not send the power control signal 18 of ON to the FET 17. The predetermined time is a previously set time and can be determined as appropriate.

Figure 10:
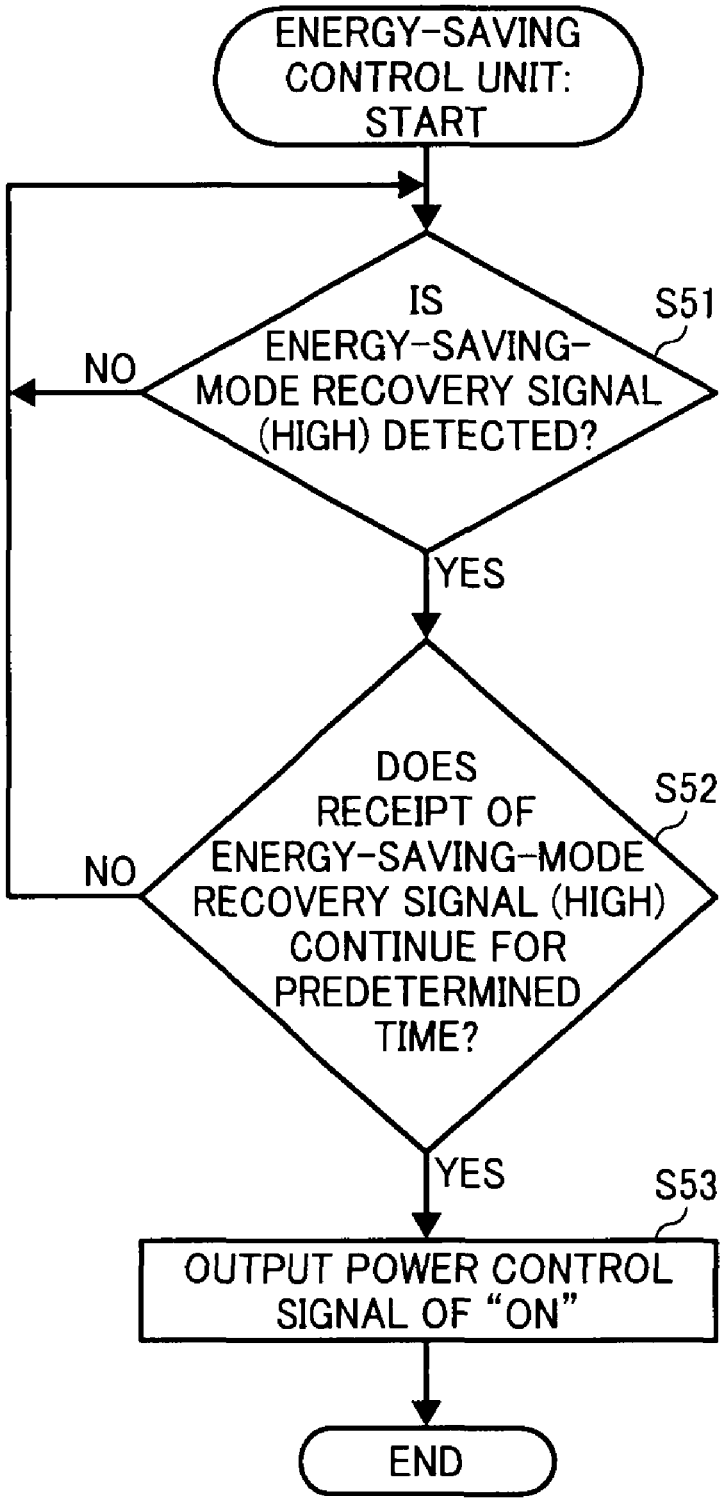
FIG. 10 is a flowchart of an energy-saving-mode recovery process according to the fifth embodiment.

An energy-saving-mode recovery process performed by the image forming system according to the fifth embodiment is described with reference to a flowchart shown in FIG. 10.

When the power source of the image forming apparatus 10 is OFF, the energy-saving control unit 906 turns OFF the FET 17 by the power control signal 18. At this state, power supply to the Ethernet I/F 7 is suspended. The energy-saving-mode recovery process is a recovery process from the energy saving mode in which power supply to the Ethernet I/F 7 is suspended.

When power supply to the Ethernet I/F 7 is suspended in the external controller 900, the energy-saving control unit 906 awaits the energy-saving-mode recovery signal 19 at high level indicating that power supply is started to the image forming apparatus 10 (Step S51).

When the power source V0 of the image forming apparatus 10 is turned ON while power supply to the Ethernet I/F 7 of the external controller 900 is suspended, the power source V0 enters an ON state. Then, the image forming apparatus 10 changes the level of the energy-saving-mode recovery signal 19 from low level to high level and sends the energy-saving-mode recovery signal 19 to the external controller 900.

Upon receipt of the energy-saving-mode recovery signal 19 at high level (Yes at Step S51), the energy-saving control unit 906 determines that power is being supplied to the image forming apparatus 10. Then, the timer 905 starts measuring a time. The energy-saving control unit 906 determines whether receipt of the energy-saving-mode recovery signal 19 at high level continues for a predetermined time (Step S52).

When the receipt of the energy-saving-mode recovery signal 19 at high level does not continue for a predetermined time (No at Step S52), process control returns to Step S51 and the energy-saving control unit 906 awaits the energy-saving-mode recovery signal 19.

On the other hand, when the receipt of the energy-saving-mode recovery signal 19 at high level continues for a predetermined time (Yes at Step S52), the energy-saving control unit 906 sets the power control signal 18 to ON and outputs the power control signal 18 of ON to the FET 17 (Step S53). Upon receipt of the power control signal 18 of ON, the FET 17 enters an ON state and restarts power supply to the circuits such as the Ethernet I/F 7 in the energy saving mode in the external controller 900. As a result, the external controller 900 recovers from the energy saving mode.

As described above, according to the fifth embodiment, only when power is being supplied to the image forming apparatus 10 for a predetermined time, power supply to the circuits in the energy saving mode in the external controller 900 is started. Therefore, it is possible to prevent erroneous detection caused by noise upon detection of power supply.

A sixth embodiment of the present invention is described below. An image forming system according to the sixth embodiment starts power supply to an image forming apparatus only when receipt of an energy-saving-mode recovery signal continues for a predetermined time. Therefore, erroneous detection caused by noise can be prevented.

Figure 11:
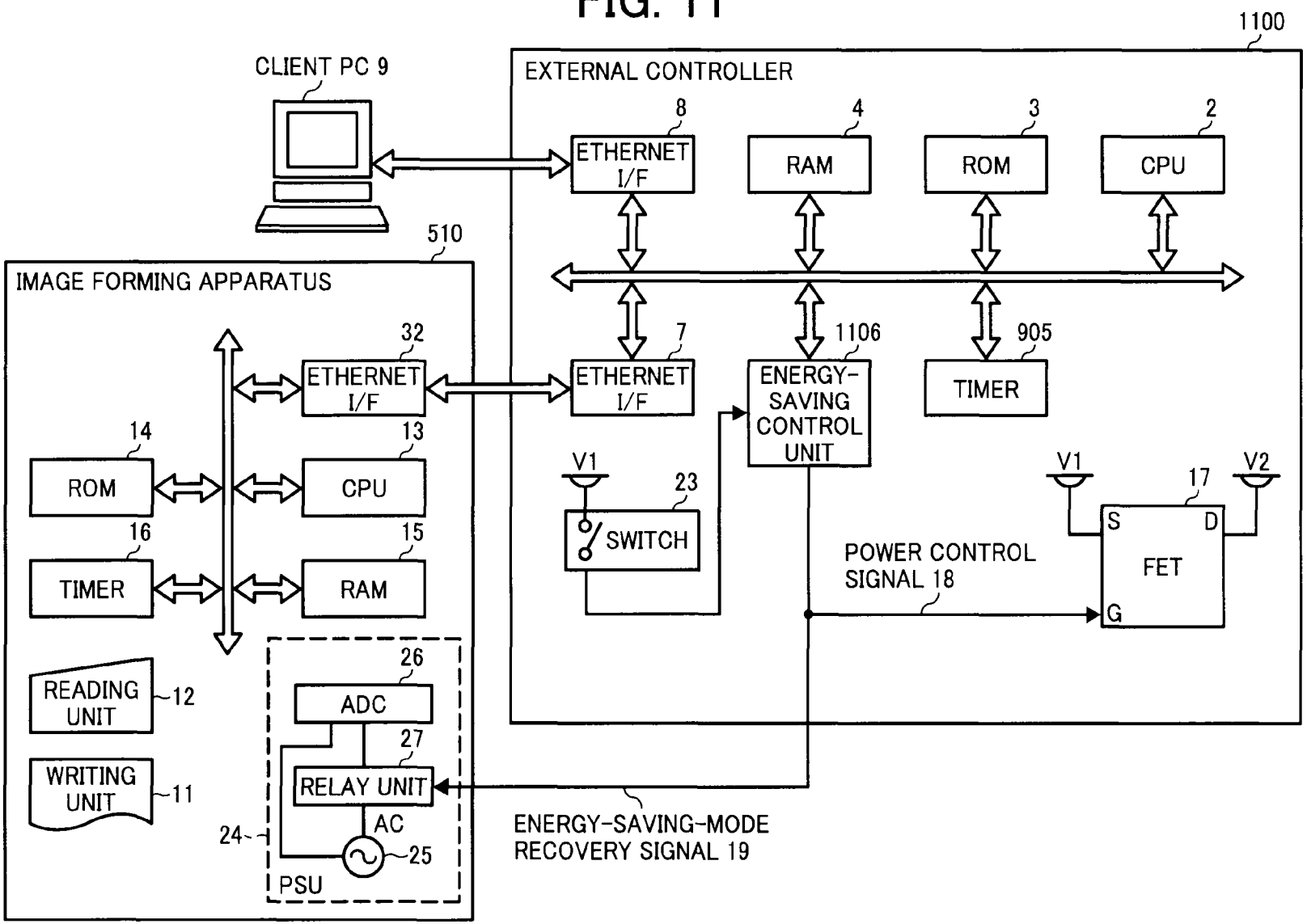
FIG. 11 is a block diagram of an image forming system according to a sixth embodiment of the present invention.

FIG. 11 is a block diagram of the image forming system according to the sixth embodiment. The image forming system according to the sixth embodiment includes an external controller 1100 and the image forming apparatus 510 connected to each other via Ethernet (registered trademark). The image forming apparatus 510 is the same as that described in the third embodiment.

The external controller 1100 includes the CPU 2, the ROM 3, the RAM 4, the timer 905, an energy-saving control unit 1106, the Ethernet I/Fs 7 and 8, the FET 17, and the switch 23, connected to one another via a system bus. The energy-saving control unit 1106 controls ON/OFF of the FET 17 based on events associated with transition and recovery to and from an energy saving mode. The CPU 2, the ROM 3, the RAM 4, the switch 23, the Ethernet I/Fs 7 and 8, and the FET 17 are the same as those described in the third embodiment, so that the same explanations are not repeated. The external controller 1100 generates the energy-saving-mode recovery signal 19, similar to the third embodiment.

The timer 905 measures time to acquire a synchronous timing of the units, similar to the first and the third embodiments. The timer 905 receives a command from the CPU 2 and measures time from when the energy-saving control unit 1106 receives the energy-saving-mode recovery signal 19, similar to the fifth embodiment.

Upon receipt of the energy-saving-mode recovery signal 19 at high level from the switch 23, the energy-saving control unit 1106 determines whether the energy-saving-mode recovery signal 19 at high level is continuously detected for a predetermined time. The predetermined time is measured by the timer 905 from when the energy-saving control unit 1106 receives the energy-saving-mode recovery signal 19. That is, it is determined whether receipt of the energy-saving-mode recovery signal 19 at high level continues for a predetermined time. When the energy-saving-mode recovery signal 19 at high level is continuously detected for the predetermined time, the energy-saving control unit 1106 sends to the FET 17 the power control signal 18 of ON that leads to a start of power supply to the circuits on the external controller 1100, so that the FET 17 is powered ON. At the same time, the energy-saving control unit 1106 sends the power control signal 18 of ON to the PSU 24 of the image forming apparatus 510, so that the relay unit 27 is turned ON.

On the other hand, when the energy-saving-mode recovery signal 19 at high level is not continuously detected for the predetermined time, the energy-saving control unit 1106 does not perform the above processing.

Figure 12:
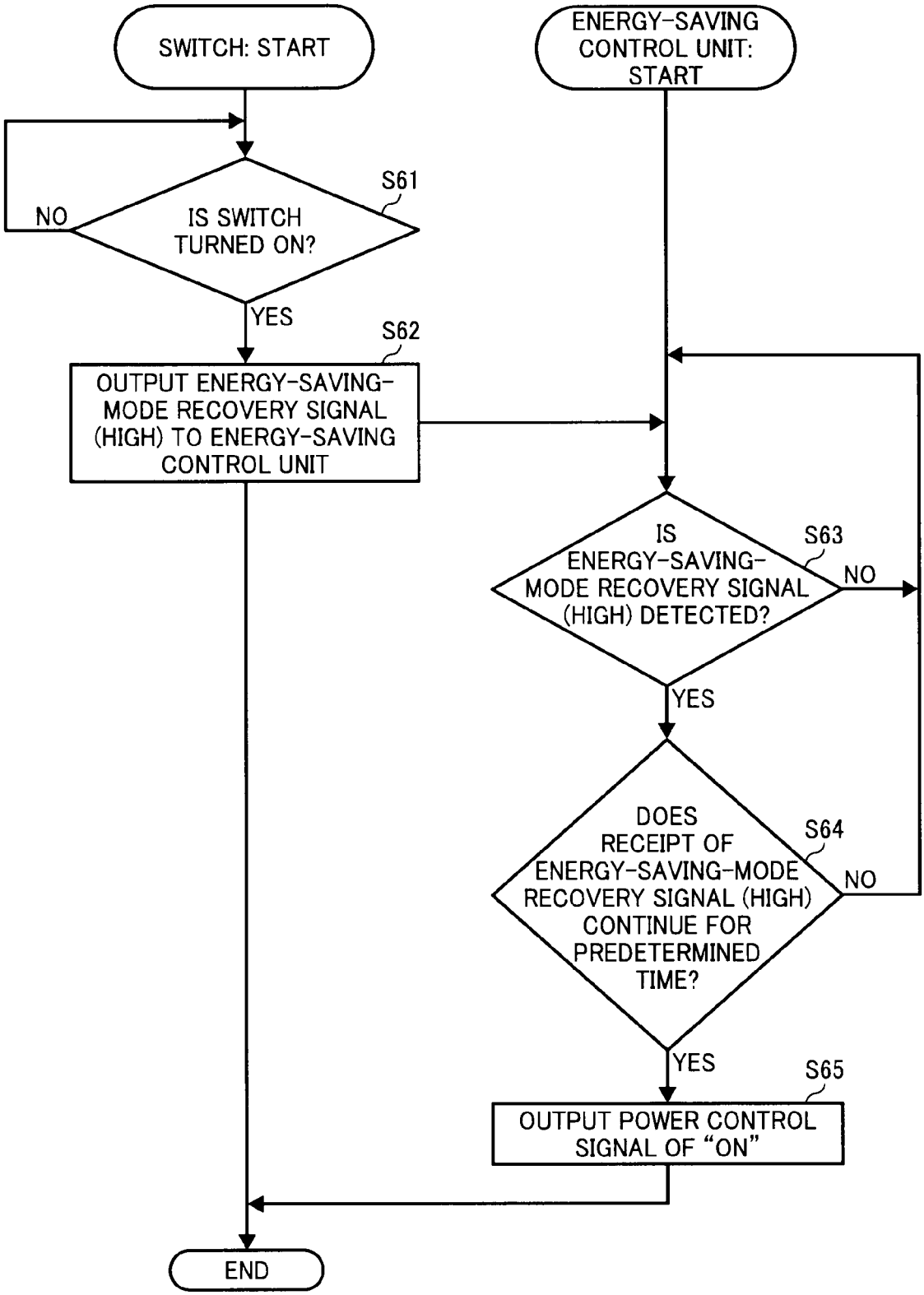
FIG. 12 is a flowchart of an energy-saving-mode recovery process according to the sixth embodiment.

An energy-saving-mode recovery process performed by the image forming system according to the sixth embodiment is described with reference to a flowchart shown in FIG. 12.

When the power source of the image forming apparatus 510 is OFF, the energy-saving control unit 1106 turns OFF the FET 17 by the power control signal 18. At this state, power supply to the Ethernet I/F 7 is suspended. The energy-saving-mode recovery process is a process for recovering from the energy saving mode in which power supply to the Ethernet I/F 7 is suspended.

When the switch 23 is pressed, the switch 23 is turned ON (Yes at Step S61). The energy-saving-mode recovery signal 19 is set to high level and sent to the energy-saving control unit 1106 (Step S62).

When the energy-saving control unit 1106 detects the energy-saving-mode recovery signal 19 at high level (Yes at Step S63), the timer 905 starts measuring a time. The energy-saving control unit 1106 determines whether receipt of the energy-saving-mode recovery signal 19 at high level continues for a predetermined time (Step S64).

When the receipt of the energy-saving-mode recovery signal 19 at high level does not continue for the predetermined time (No at Step S64), process control returns to Step S63 and the energy-saving control unit 1106 awaits the energy-saving-mode recovery signal 19.

On the other hand, when the receipt of the energy-saving-mode recovery signal 19 at high level continues for a predetermined time (Yes at Step S64), the energy-saving control unit 1106 sets the power control signal 18 to ON and outputs the power control signal 18 of ON to the FET 17 and the relay unit 27 of the image forming apparatus 510 (Step S65). Upon receipt of the power control signal 18 of ON, the FET 17 enters an ON state and restarts power supply to the circuits such as the Ethernet I/F 7 in the energy saving mode in the external controller 1100. As a result, the external controller 1100 recovers from the energy saving mode.

In the image forming apparatus 510, the relay unit 27 is powered ON upon receipt of the power control signal 18 of ON. As a result, the PSU 24 supplies power to the image forming apparatus 510.

As described above, according to the sixth embodiment, only when the energy-saving control unit 1106 continuously receives the energy-saving-mode recovery signal 19 for a predetermined time, power supply to the circuits in the energy saving mode in the external controller 1100 is restarted and power supply to the image forming apparatus 510 is started. Therefore, erroneous detection caused by noise upon detection of power supply can be prevented.

A seventh embodiment of the present invention is described below. When generation of the energy-saving-mode recovery signal 19 is detected and a restart of power supply to the circuits in the energy saving mode in an external controller is detected, power supply to an image forming apparatus is started. Therefore, erroneous detection caused by noise can be prevented.

Figure 13:
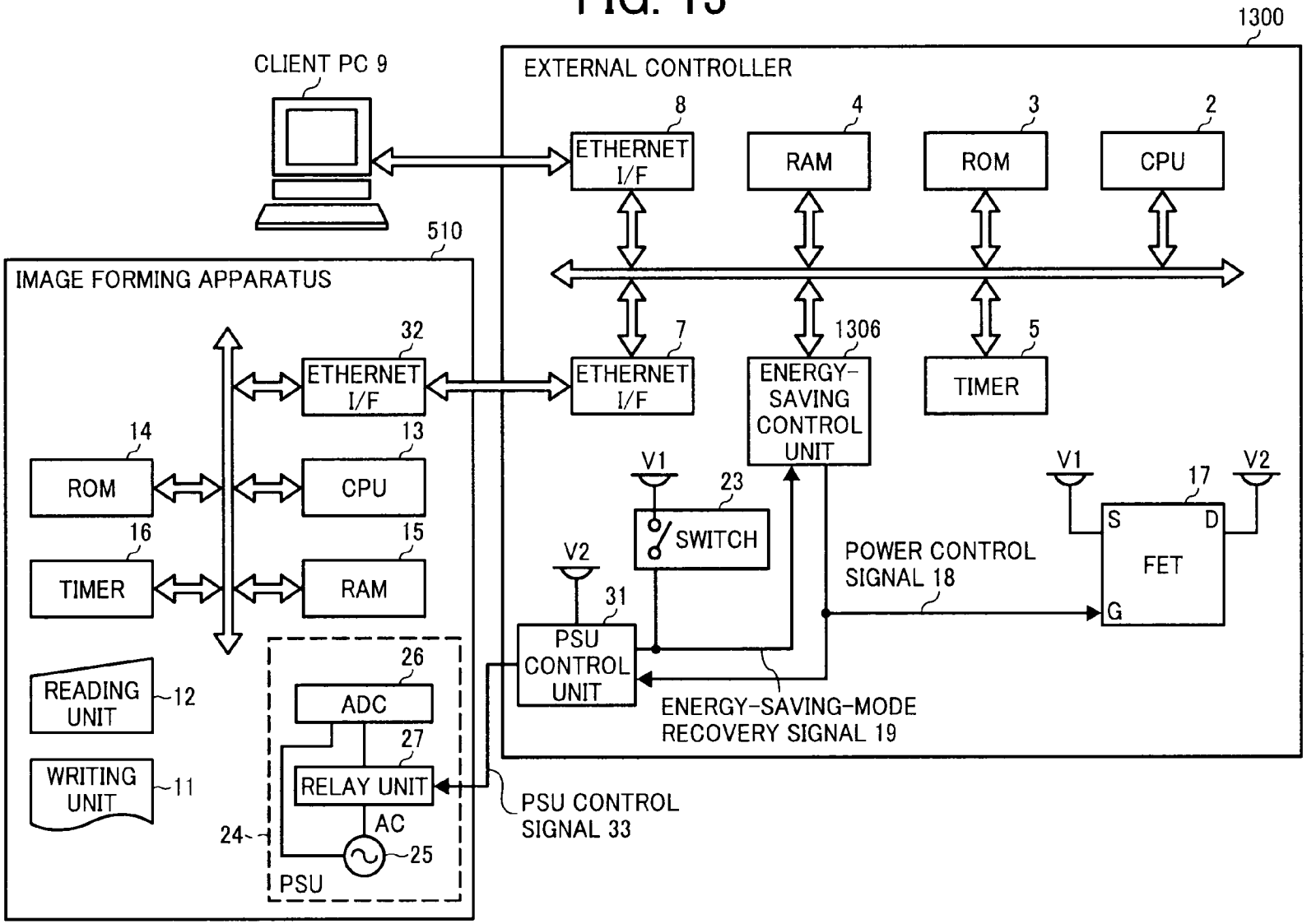
FIG. 13 is a block diagram of an image forming system according to a seventh embodiment of the present invention.

FIG. 13 is a block diagram of an image forming system according to the seventh embodiment. The image forming system according to the seventh embodiment includes an external controller 1300 and the image forming apparatus 510 connected to each other via Ethernet (registered trademark). The image forming apparatus 510 is the same as that described in the third embodiment.

The external controller 1300 includes the CPU 2, the ROM 3, the RAM 4, the timer 5, an energy-saving control unit 1306, the Ethernet I/Fs 7 and 8, the FET 17, the switch 23, and a PSU control unit 31, connected to one another via a system bus. The energy-saving control unit 1306 controls ON/OFF of the FET 17 based on events associated with transition and recovery to and from an energy saving mode. The CPU 2, the ROM 3, the RAM 4, the switch 23, the Ethernet I/Fs 7 and 8, and the FET 17 are the same as those described in the third embodiment. The timer 5 is the same as that described in the first embodiment. The external controller 1300 generates the energy-saving-mode recovery signal 19, similar to the third embodiment.

Upon receipt of the energy-saving-mode recovery signal 19 at high level from the switch 23, the energy-saving control unit 1306 turns ON the FET 17 by the power control signal 18 that controls the gate of the FET 17. As a result, power supply to the units in the energy saving mode in the external controller 1300 is started. The power control signal 18 of ON output from the energy-saving control unit 1306 is divided, and divided one of the power control signal 18 of ON is output to the PSU control unit 31. On the other hand, upon receipt of the energy-saving-mode recovery signal 19 at low level, the energy-saving control unit 1306 turns OFF the FET 17 by the power control signal 18. Therefore, power supply to the circuits on the external controller 1300 is suspended.

Upon receipt of the power control signal 18 of ON from the energy-saving control unit 1306, a power source V2 starts supplying power to the PSU control unit 31. The PSU control unit 31 is connected to the relay unit 27 of the PSU 24. The PSU control unit 31 sets a level of a PSU control signal 33 to high level and sends the PSU control signal 33 to the relay unit 27 only when the energy-saving-mode recovery signal 19 at high level is received from the energy-saving control unit 1306 and power is supplied from the power source V2 (i.e., when the power control signal 18 of ON is received from the energy-saving control unit 1306). The level of the PSU control signal 33 is set to low level in situations other than that described above.

When the PSU control signal 33 is at high level, the relay unit 27 is powered ON so that power supply to the image forming apparatus 510 is started. When the PSU control signal 33 is at low level, the relay unit 27 is powered OFF so that power supply to the image forming apparatus 510 is suspended.

Figure 14:
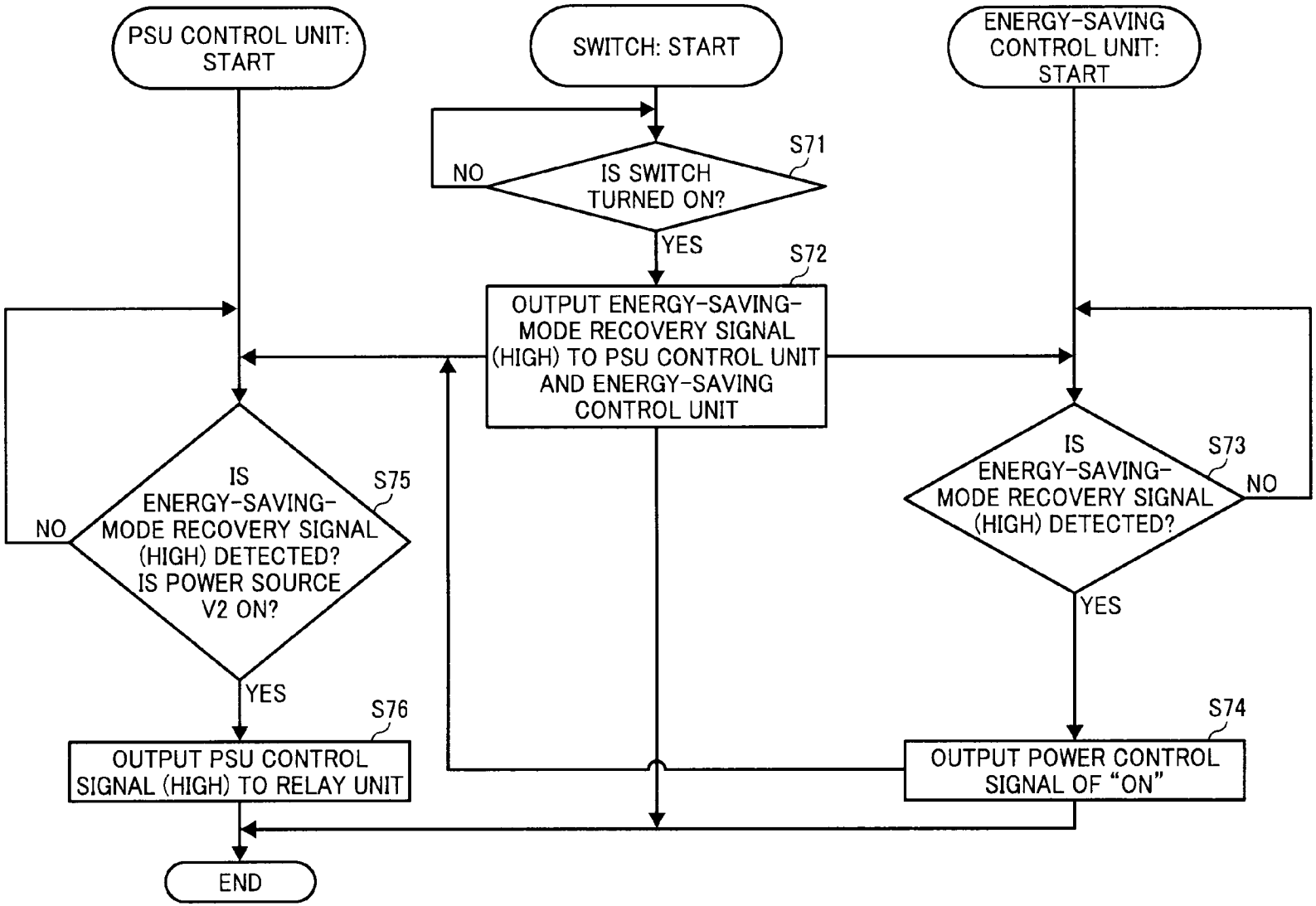
FIG. 14 is a flowchart of an energy-saving-mode recovery process according to the seventh embodiment.

An energy-saving-mode recovery process performed by the image forming system according to the seventh embodiment is described with reference to a flowchart shown in FIG. 14.

When the power source of the image forming apparatus 510 is OFF, the energy-saving control unit 1306 turns OFF the FET 17 by the power control signal 18. At this state, power supply to the Ethernet I/F 7 is suspended. The energy-saving-mode recovery process is a recovery process from the energy saving mode in which power supply to the Ethernet I/F 7 is suspended.

When the switch 23 is pressed, the switch 23 is turned ON (Yes at Step S71). The energy-saving-mode recovery signal 19 is set to high level and sent to the energy-saving control unit 1306 and the PSU control unit 31 (Step S72).

Upon detection of the energy-saving-mode recovery signal 19 at high level (Yes at Step S73), the energy-saving control unit 1306 sets the power control signal 18 to ON and outputs the power control signal 18 of ON to the FET 17 and the PSU control unit 31 (Step S74). Upon receipt of the power control signal 18 of ON, the FET 17 enters an ON state and restarts power supply to the circuits such as the Ethernet I/F 7 in the energy saving mode in the external controller 1300. As a result, the external controller 1300 recovers from the energy saving mode.

The PSU control unit 31 determines whether the energy-saving-mode recovery signal 19 at high level is received and the power source V2 is ON upon receipt of the power control signal 18 of ON (Step S75). When the energy-saving-mode recovery signal 19 at high level is received at Step S72 and the power source V2 is ON at Step S74 (Yes at Step S75), the PSU control unit 31 sends the PSU control signal 33 at high level to the relay unit 27 (Step S76). Thus, the relay unit 27 is powered ON and the PSU 24 supplies power to the image forming apparatus 510.

As described above, according to the seventh embodiment, when generation of the energy-saving-mode recovery signal 19 is detected and restart of power supply to the circuits in the energy saving mode in the external controller is detected, power supply to the image forming apparatus is started. Therefore, erroneous detection caused by noise can be prevented.

An eighth embodiment of the present invention is described below. Similar to the seventh embodiment, when generation of the energy-saving-mode recovery signal 19 is detected and restart of power supply to the circuits in the energy saving mode in an external controller is detected, power supply to an image forming apparatus is started. Therefore, erroneous detection caused by noise can be prevented.

Figure 15:
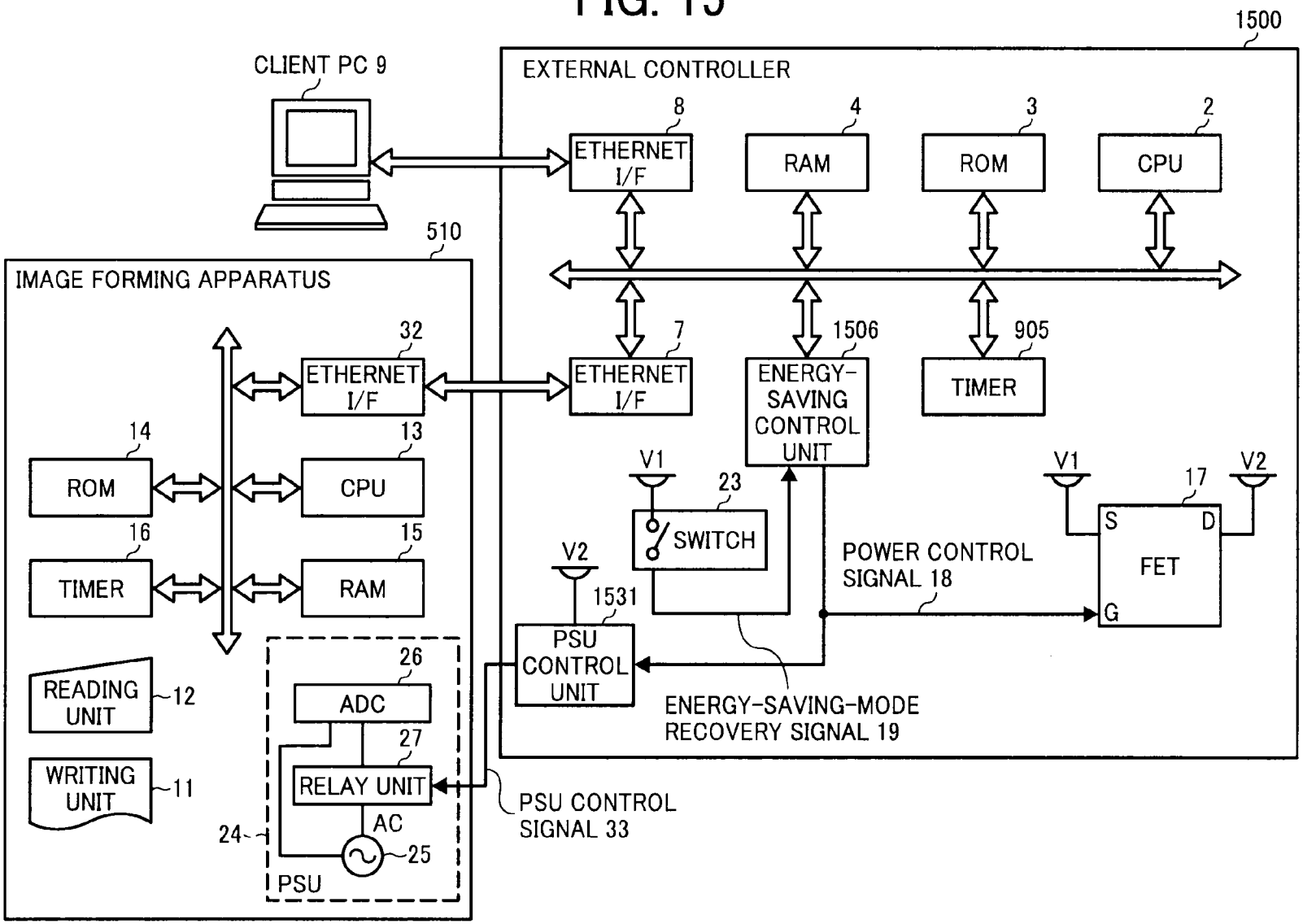
FIG. 15 is a block diagram of an image forming system according to a eighth embodiment of the present invention.

FIG. 15 is a block diagram of an image forming system according to the eighth embodiment. The image forming system according to the eighth embodiment includes an external controller 1500 and the image forming apparatus 510 connected to each other via Ethernet (registered trademark). The image forming apparatus 510 is the same as that described in the third embodiment.

The external controller 1500 includes the CPU 2, the ROM 3, the RAM 4, the timer 905, an energy-saving control unit 1506, the Ethernet I/Fs 7 and 8, the FET 17, the switch 23, and a PSU control unit 1531, connected to one another via a system bus. The energy-saving control unit 1506 controls ON/OFF of the FET 17 based on events associated with transition and recovery to and from an energy saving mode.

The CPU 2, the ROM 3, the RAM 4, the switch 23, the Ethernet I/Fs 7 and 8, and the FET 17 are the same as those described in the seventh embodiment. The timer 905 is the same as that described in the fifth embodiment. The external controller 1500 generates the energy-saving-mode recovery signal 19, similar to the third embodiment.

Upon receipt of the energy-saving-mode recovery signal 19 at high level from the switch 23, the energy-saving control unit 1506 determines whether receipt of the energy-saving-mode recovery signal 19 at high level continues for a predetermined time. The predetermined time is measured by the timer 905 from when the energy-saving control unit 1506 receives the energy-saving-mode recovery signal 19 at high level. When the receipt of the energy-saving-mode recovery signal 19 at high level continues for a predetermined time, the energy-saving control unit 1506 sets the power control signal 18 to ON and restarts power supply to the circuits such as the Ethernet I/F 7 in the energy saving mode. Furthermore, the power control signal 18 of ON output from the energy-saving control unit 1506 is divided, and divided one of the power control signal 18 of ON is output to the PSU control unit 1531.

The power source V2 supplies power to the PSU control unit 1531. The PSU control unit 1531 is connected to the relay unit 27 of the PSU 24. The PSU control unit 1531 sets a level of the PSU control signal 33 to high level and sends the PSU control signal 33 to the relay unit 27 only when power is supplied from the power source V2. The level of the PSU control signal 33 is set to low level in situations other than one described above.

When the PSU control signal 33 is at high level, the relay unit 27 is powered ON so that power supply to the image forming apparatus 510 is started. When the PSU control signal 33 is at low level, the relay unit 27 is powered OFF so that power supply to the image forming apparatus 510 is suspended.

Figure 16:
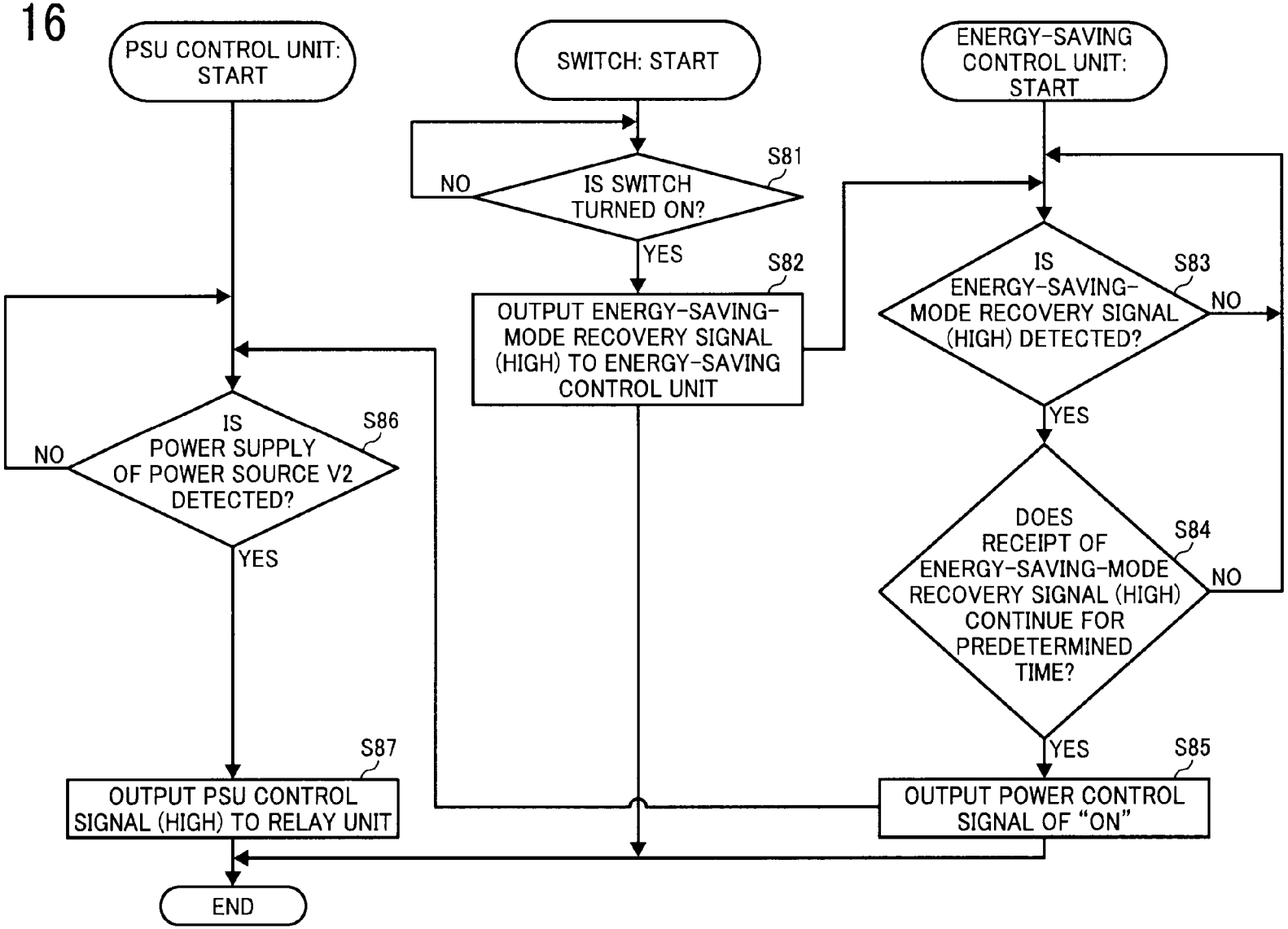
FIG. 16 is a flowchart of an energy-saving-mode recovery process according to the eighth embodiment.

An energy-saving-mode recovery process performed by the image forming system according to the eighth embodiment is described with reference to a flowchart shown in FIG. 16.

When the power source of the image forming apparatus 510 is OFF, the energy-saving control unit 1506 turns OFF the FET 17 by the power control signal 18. At this state, power supply to the Ethernet I/F 7 is suspended. The energy-saving-mode recovery process is a recovery process from the energy saving mode in which power supply to the Ethernet I/F 7 is suspended.

When the switch 23 is pressed, the switch 23 is turned ON (Yes at Step S81). The energy-saving-mode recovery signal 19 is set to high level and sent to the energy-saving control unit 1506 (Step S82).

Upon receipt of the energy-saving-mode recovery signal 19 at high level from the switch 23 (Yes at Step S83), the timer 905 starts measuring a time. Then, the energy-saving control unit 1506 determines whether receipt of the energy-saving-mode recovery signal 19 at high level continues for a predetermined time (Step S84).

When the receipt of the energy-saving-mode recovery signal 19 at high level does not continue for the predetermined time (No at Step S84), process control returns to Step S83 and the energy-saving control unit 1506 awaits the energy-saving-mode recovery signal 19.

On the other hand, when the receipt of the energy-saving-mode recovery signal 19 at high level continues for the predetermined time (Yes at Step S84), the energy-saving control unit 1506 sets the power control signal 18 to ON and outputs the power control signal 18 of ON to the FET 17 and the PSU control unit 1531 (Step S85). Upon receipt of the power control signal 18 of ON, the FET 17 enters an ON state and restarts power supply to the circuits such as the Ethernet I/F 7 in the energy saving mode in the external controller 1500. As a result, the external controller 1500 recovers from the energy saving mode.

The PSU control unit 1531 determines whether the power source V2 is ON upon receipt of the power control signal 18 of ON (Step S86). When the power source V2 is ON at Step S85 (Yes at Step S86), the PSU control unit 1531 sends the PSU control signal 33 at high level to the relay unit 27 (Step S87). Thus, the relay unit 27 is powered ON and the PSU 24 supplies power to the image forming apparatus 510.

As described above, according to the eighth embodiment, when generation of the energy-saving-mode recovery signal 19 is detected and restart of power supply to the circuits in the energy saving mode in an external controller is detected, power supply to an image forming apparatus is started. Therefore, erroneous detection caused by noise can be prevented.

An energy-saving-mode recovery program executed by the external controllers according to the first to the eighth embodiments is provided by recording media such as ROM.

The energy-saving-mode recovery program can be distributed using files that can be installed and executed by computers and the files can be provided by using computer executable recording media such as CD-ROM, flexible disk (FD), CD-R, DVD (digital versatile disk).

Furthermore, the energy-saving-mode recovery program can be stored in computers connected to a network such as the Internet in a downloadable manner. The energy-saving-mode recovery program can be provided and distributed using a network such as the Internet.

The energy-saving-mode recovery program has a module structure containing the units described above. In terms of hardware structure, a CPU (processor) reads computer programs such as the energy-saving-mode recovery program from the ROM and executes the energy-saving-mode recovery program. Therefore, the above units are loaded on a main storage and then generated on the main storage.

The present invention is not limited to the specific details and representative embodiments described above. Accordingly, various modifications can be made without departing from spirit or scope of the present invention. That is, one or some of the above units can be combined or deleted as appropriate in a single embodiment or over a plurality of the embodiments described above.

According to an aspect of the present invention, the external controller can recover from the energy saving mode in conjunction with a start of power supply to the image forming apparatus. Therefore, power consumption can be reduced while the external controller can be promptly recovered from the energy saving mode.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming system in which an image forming apparatus and an external controller are connected to each other via a network, wherein the image forming apparatus includes a power supply unit that supplies power to the image forming apparatus, the external controller includes an energy-saving control unit that detects a supply of power to the image forming apparatus by the power supply unit and performs an energy saving control of the external controller based on a detection of the supply of power to the image forming apparatus, and a switching unit that switches a start and a stop of supply of power to an onboard circuit of the external controller, upon detecting the supply of power to the image forming apparatus by the power supply unit, the energy-saving control unit sends a power control signal for instructing a start of the supply of power to the onboard circuit to the switching unit, and upon receiving the power control signal, the switching unit switches to the start of the supply of power to the onboard circuit.

2. The image forming system according to claim 1, wherein the external controller further includes a timing unit that measures a predetermined time from a time when the energy-saving control unit detects the supply of power to the image forming apparatus, and upon detecting the supply of power to the image forming apparatus for the predetermined time, the energy-saving control unit sends the power control signal to the switching unit.

3. The image forming system according to claim 1, wherein upon receiving a recovery signal indicating that the supply of power to the image forming apparatus is started, the energy-saving control unit determines that the supply of power to the image forming apparatus is detected.

4. The image forming system according to claim 1, wherein the external controller further includes a level-change detecting unit that detects a change of a level of a signal communicated over the network, wherein when the change of the level of is detected, the energy-saving control unit determines that the supply of power to the image forming apparatus is detected.

5. The image forming system according to claim 4, wherein upon detecting the change of the level of the signal, the level-change detecting unit sends a recovery signal indicating that the supply of power to the image forming apparatus is started to the energy-saving control unit, and upon receiving the recovery signal, the energy-saving control unit determines that the supply of power to the image forming apparatus is detected.

6. The image forming system according to claim 1, wherein the image forming apparatus further includes a light emitting unit that emits a light in conjunction with the supply of power to the image forming apparatus, the external controller further includes a light detecting unit that detects the light emitted by the light emitting unit, and when the light detecting unit detects the light emitted by the light emitting unit, the energy-saving control unit determines that the supply of power to the image forming apparatus is detected.

7. The image forming system according to claim 6, wherein upon detecting the light emitted by the light emitting unit, the light detecting unit sends a recovery signal indicating that the supply of power to the image forming apparatus is started to the energy-saving control unit, and upon receiving the recovery signal, the energy-saving control unit determines that the supply of power to the image forming apparatus is detected.

8. The image forming system according to claim 1, wherein the external controller further includes a signal generating unit that generates a recovery signal instructing to start the supply of power, and sends the recovery signal to the energy-saving control unit and the power supply unit, and upon receiving the recovery signal, the power supply unit starts the supply of power to the image forming apparatus, and the energy-saving control unit sends the power control signal to the switching unit.

9. The image forming system according to claim 1, wherein the external controller further includes a signal generating unit that generates a recovery signal instructing to start the supply of power, and sends the recovery signal to the energy-saving control unit, and a timing unit that measures a predetermined time from a time when the energy-saving control unit receives the recovery signal, and upon receiving the recovery signal continuously for the predetermined time, the energy-saving control unit sends the power control signal to the switching unit and the power supply unit.

10. The image forming system according to claim 1, wherein the external controller further includes a power-supply control unit that sends a power-supply control signal instructing to start the supply of power to the image forming apparatus to the power supply unit, and a signal generating unit that generates a recovery signal instructing to start the supply of power to the external controller, and sends the recovery signal to the energy-saving control unit and the power-supply control unit, upon receiving the recovery signal and the power control signal, the power-supply control unit sends the power-supply control signal to the power supply unit, and upon receiving the recovery signal, the energy-saving control unit sends the power control signal to the switching unit and the power-supply control unit.

11. The image forming system according to claim 1, wherein the external controller further includes a power-supply control unit that sends a power-supply control signal instructing to start the power supply unit to the image forming apparatus to the power supply unit, a signal generating unit that generates a recovery signal instructing to start the supply of power to the external controller, and sends the recovery signal to the energy-saving control unit, and a timing unit that measures a predetermined time from a time when the energy-saving control unit receives the recovery signal, upon receiving the recovery signal, the energy-saving control unit sends the power control signal to the switching unit and the power-supply control unit, and upon receiving the power control signal, the power-supply control unit sends the power-supply control signal to the power supply unit.

12. An image forming apparatus configured to be connected to an external controller via a network, the image forming apparatus comprising:

a main power supply unit that supplies power to a plurality of components of the image forming apparatus; and a signal transmitting unit that transmits, when the main power supply unit starts supplying the power to the image forming apparatus, a signal indicating that supply of power to the image forming apparatus is started to the external controller.

13. The image forming apparatus according to claim 12, wherein the transmitting unit includes a light emitting unit that emits a light to generate an optical signal in conjunction with the supply of power to the image forming apparatus, and transmits the optical signal as the signal indicating that the supply of power to the image forming apparatus is started.

14. The image forming apparatus according to claim 12, further comprising a signal receiving unit that receives the signal indicating that the supply of power to the image forming apparatus is started from the external controller.

15. An energy saving recovery method for an image forming system including an image forming apparatus and an external controller connected to each other via a network, the energy saving recovery method comprising:

energy-saving controlling including an energy-saving control unit of the external controller detecting a supply of power to the image forming apparatus by a power supply unit and performing an energy saving control of the external controller based on a detection of the supply of power to the image forming apparatus; and switching including a switching unit of the external controller switching a start and a stop of supply of power to an onboard circuit of the external controller, wherein upon detecting the supply of power to the image forming apparatus by the power supply unit, the energy-saving controlling further includes sending a power control signal for instructing a start of the supply of power to the onboard circuit to the switching unit, and upon receiving the power control signal, the switching further includes switching to the start of the supply of power to the onboard circuit.

* * * * *